US010749265B2

(12) United States Patent
Quarfoth et al.

(10) Patent No.: US 10,749,265 B2
(45) Date of Patent: Aug. 18, 2020

(54) SURFACE WAVE POLARIZATION CONVERTER

(71) Applicant: HRL Laboratories, LLC, Malibu, CA (US)

(72) Inventors: Ryan G. Quarfoth, Los Angeles, CA (US); Amit M. Patel, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 377 days.

(21) Appl. No.: 15/214,420

(22) Filed: Jul. 19, 2016

(65) Prior Publication Data

US 2017/0025765 A1 Jan. 26, 2017

Related U.S. Application Data

(60) Provisional application No. 62/194,743, filed on Jul. 20, 2015.

(51) Int. Cl.
*H01Q 15/24* (2006.01)
*H01Q 21/06* (2006.01)
(Continued)

(52) U.S. Cl.
CPC ..... *H01Q 15/246* (2013.01); *H01Q 1/36* (2013.01); *H01Q 1/48* (2013.01); *H01Q 9/0407* (2013.01); *H01Q 21/065* (2013.01)

(58) Field of Classification Search
CPC ..... H01Q 9/0407; H01Q 15/242–0478; H01Q 15/08
See application file for complete search history.

(56) References Cited

U.S. PATENT DOCUMENTS 7,911,407 B1 3/2011 Fong et al.
2008/0224947 A1 9/2008 Werner et al.
(Continued)

FOREIGN PATENT DOCUMENTS

WO 2015/090351 A1 6/2015

OTHER PUBLICATIONS

B. H. Fong, J. S. Colburn, J. J. Ottusch, J. L. Visher and D. F. Sievenpiper, "Scalar and Tensor Holographic Artificial Impedance Surfaces," in IEEE Transactions on Antennas and Propagation, vol. 58, No. 10, pp. 3212-3221, Oct. 2010. (Year: 2010).*
(Continued)

*Primary Examiner* — Daniel Munoz
*Assistant Examiner* — Amal Patel
(74) *Attorney, Agent, or Firm* — Ladas & Parry

(57) ABSTRACT

A method and apparatus for converting electromagnetic surface waves from TE mode to TM mode or from TM mode to TE mode. The apparatus includes a dielectric surface having an anisotropic impedance tensor which is preferably obtained by a plurality of electrically conductive unit cells disposed on the dielectric surface and arranged in a two dimensional array of unit cells, a majority of the unit cells in said array being divided into at least two portions, with at least one gap separating the at least two portions from each other into two or more patches or plates, the array of unit cells having a surface wave input end and a surface wave output end, gaps in the unit cells disposed closest to the surface wave input end having a first orientation and gaps in said unit cells disposed closest to the surface wave output end having a second orientation different than said first orientation. The electromagnetic surface waves have a frequency greater than a TE cutoff frequency determined by a second solution of Maxwell's equations for said dielectric surface.

25 Claims, 17 Drawing Sheets

(51) Int. Cl.

| | |
|---|---|
| ***H01Q 1/36*** | (2006.01) |
| ***H01Q 1/48*** | (2006.01) |
| ***H01Q 9/04*** | (2006.01) |

(56) References Cited

U.S. PATENT DOCUMENTS

| | | | |
|---|---|---|---|
| 2009/0284404 | A1 | 11/2009 | Sim et al. |
| 2013/0214982 | A1 | 8/2013 | Dean et al. |
| 2015/0171498 | A1 | 6/2015 | McKinzie, III |

OTHER PUBLICATIONS

PCT International Preliminary Report on Patentability (Chapter I) with Written Opinion from PCT/US2016/043023 dated Jan. 23, 2018.

International Search Report and Written Opinion for related PCT application PCT/US16/43023, dated Oct. 20, 2016.

Colburn, J.S.; Lai, A.; Sievenpiper, D.F.; Bekaryan, A.; Fong, B.H.; Ottusch, J.J.; Tulythan, P.; , "Adaptive artificial impedance surface conformal antennas," Antennas and Propagation Society International Symposium, 2009. APSURSI '09. IEEE , vol., no., pp. 1-4, Jun. 1-5, 2009.

Fong, B. et al, "Scalar and Tensor Holographic Artificial Impedance Surfaces," IEEE TAP., vol. 58, No. 10, pp. 3212-3221, Oct. 2010.

Gregoire, D.J. and Colburn, J.S., Artificial impedance surface antenna design and simulation, Proc. Antennas Appl. Symposium 2010, vol. II, pp. 288-303 (269 pages attached).

Gregoire, D.J. and Colburn, J.S., Artificial impedance surface antennas, Proceedings of the 2011 Antenna Applications Symposium, 2011 (13 pages).

Gregoire, D.J. and Kabakian, A.V., "Surface-Wave Waveguides," Antennas and Wireless Propagation Letters, IEEE , Vo. 10, 2011, pp. 1512-1515.

Luukkonen, O.; Simovski, C.; Granet, G.; Goussetis, G.; Lioubtchenko, D.; Raisanen, A.V.; Tretyakov, S.A., "Simple and Accurate Analytical Model of Planar Grids and High-Impedance Surfaces Comprising Metal Strips or Patches," IEEE Transactions on *Antennas and Propagation*, vol. 56, No. 6, pp. 1624,1632, Jun. 2008.

Patel, A.M.; Grbic, A., "A Printed Leaky-Wave Antenna Based on a Sinusoidally-Modulated Reactance Surface," IEEE Transactions on Antennas and Propagation, vol. 59, No. 6, pp. 2087-2096, Jun. 2011.

Patel, A.M.; Grbic, A., "Modeling and Analysis of Printed-Circuit Tensor Impedance Surfaces," IEEE Transactions on Antennas and Propagation, vol. 61, No. 1, pp. 211-220, Jan. 2013.

Quarfoth, R.; Sievenpiper, D., "Artificial Tensor Impedance Surface Waveguides," IEEE Transactions on Antennas and Propagation, vol. 61, No. 7, pp. 3597-3606, Jul. 2013.

Quarfoth, R.; Sievenpiper, D., "Broadband Unit-Cell Design for Highly Anisotropic Impedance Surfaces," IEEE Transactions on Antennas and Propagation, vol. 62, No. 8, pp. 4143-4152, Aug. 2014.

Sievenpiper, D. et al, "Holographic artifiical impendance surfaces for conformal antennas", 29th Antennas Applications Symposium, 2005 (10 pages).

Sievenpiper, D. et al., "Holographic artifiical impendance surfaces for conformal antennas", 2005 IEEE Antennas and Prop. Symp. Digest, vol. 1B, pp. 256-259, 2005.

Sievenpiper, D.; Schaffner, J.; Lee, J.J.; Livingston, S. "A steerable leaky-wave antenna using a tunable impedance ground plane," Antennas and Wireless Propagation Letters, IEEE , vol. 1, pp. 179-182, 2002.

Office Action from Chinese Patent Application No. 201680030738.X dated Dec. 20, 2019 and its English translation.

Office Action from European Patent Application No. 16828428.9 dated Oct. 31, 2019.

Anonymous: "APS/URSI 201512015 IEEE International Symposium on Antennas and Propagation and Usnc-Ursi National Radio Science Meeting | Jul. 19-24, 2015 | Vancouver, BC, Canada", Jun. 1, 2015 (Jun. 1, 2015), XP055635938, Retrieved from the Internet: URL:http://web.archive.org/web/20150601113322/http://www.2015apsursi.org/RegularProgram.asp [retrieved on Oct. 25, 2019].

Quarfoth, Ryan et al., "Surface wave polarization converter," 2015 IEEE International Symposium on Antennas and Propagation & USNC/URSI National Radio Science Meeting, IEEE, Jul. 19, 2015 (Jul. 19, 2015), pp. 659-660.

Quarfoth, Ryan et al., "Broadband Unit-Cell 1-15 Design for Highly Anisotropic Impedance Surfaces," IEEE Transactions on Antennas and Propagation, IEEE Service Center, Piscataway, NJ, US. vol. 62, No. 8, Aug. 1, 2014 (Aug. 1, 2014), pp. 4143-4152.

EPO extended search report from European Patent Application No. 16828428.9 dated Feb. 11, 2019.

* cited by examiner

SURFACE WAVE POLARIZATION CONVERTER

CROSS REFERENCE TO RELATED APPLICATIONS

This application claims the benefit of U.S. Provisional Patent Application No. 62/194,743 filed Jul. 20, 2015, the disclosure of which is hereby incorporated herein by reference.

STATEMENT REGARDING FEDERALLY SPONSORED RESEARCH OR DEVELOPMENT

None

TECHNICAL FIELD

The invention relates to devices for converting electromagnetic surface waves between the two fundamental polarizations: transverse magnetic (TM) and transverse electric (TE). TM modes have an electric field polarized in the propagating direction and normal to the surface, and magnetic field in the transverse direction. TE modes conversely have magnetic field in the propagating direction and normal directions and electric field in the transverse direction. The invention employs an impedance surface, created by patterning metallic patches on a grounded dielectric substrate, to convert the polarization of surface waves between TE and TM polarizations.

BACKGROUND

Artificial impedance surface antennas are realized by launching a surface wave across an artificial impedance surface, whose impedance is spatially modulated across the impedance surface. The basic principle of artificial impedance surface antenna operation is to use the grid momentum of the modulated impedance surface to match the wave vectors of an excited surface-wave front to a desired plane wave.

Impedance surfaces can support surface wave modes, which are TM, TE or hybrid. Hybrid modes are supported on tensor impedance surfaces (not scalar surfaces), and are a combination of TM and TE modes. These hybrid modes have previously been classified as two types, "TM-like" and "TE-like" due to their similarity with the pure TM and TE modes. TM modes have electric field polarized in the propagating direction and normal to the surface, and magnetic field in the transverse direction. TE modes conversely have magnetic field in the propagating direction and normal directions and electric field in the transverse direction.

In "Artificial Impedance Surface Antenna Design And Simulation," by D. Gregoire and J. Colburn, in *Proceedings of the* 2010 *Antenna Applications Symposium*, Vol II, 288 (2010), the authors report the development of a fast approximate method for simulation of artificial impedance surface antennas that can rapidly compute radiation patterns for flat and curved artificial impedance surfaces. As part of the development process, the authors noted that while TM-mode artificial impedance surface antennas are limited in their angular range, TE-mode artificial impedance surface antennas can radiate very efficiently at high angles of elevation because each current element is perpendicular to the surface-wave propagation, and there is no angular dependence polarization. This identifies at least one motivation for a designer to have a means to convert TE-mode and TM-mode polarizations.

Designers of electrically-scanned antennas, electromagnetic scattering, reflect arrays, waveguides and other electromagnetic devices desire the flexibility to switch between polarizations within a single design. A typical challenge for such designers has been the integration of antennas onto complex metallic shapes while retaining the desired radiation characteristics.

In "Holographic Artificial Impedance Surfaces for Conformal Antennas", by D. Sievenpiper, J. Colburn, B. Fong, J. Ottusch, and J. Visher, in 29*th Antennas Applications Symposium*, (2005), an artificial impedance surface consisting of a lattice of sub-wavelength metal patches on a grounded dielectric substrate is disclosed. The effective surface impedance of the disclosed structure depends on the size of the patches, and can be varied as a function of position. Using holography consisting of patterns of metal strips, the surface impedance is designed to generate any desired radiation pattern from currents in the surface. However, no reference is made to polarization and no disclosure of polarization conversion is disclosed.

Previous art have disclosed TM, TE, or TM-like surfaces. In "A Steerable Leaky-Wave Antenna Using A Tunable Impedance Ground Plane," by D. Sievenpiper, J. Schaffner, J. Lee, and S. Livingston, in *IEEE Antennas and Wireless Propagation Letters*, Vol. 1, No. 1, 179, (2002), a prior art steerable leaky-wave antenna is disclosed, wherein a horizontally polarized antenna couples energy into leaky transverse electric waves on a tunable textured ground plane. The tuned resonance frequency of the surface, shifts the band structure in frequency changing the tangential wave vector of the leaky waves for a fixed frequency and steering the elevation angle of the resulting radiated beam. While TM and TE modes are discussed, this prior art does not suggest or disclose a way to convert polarizations of an incident wave.

In "Simple and Accurate Analytical Model of Planar Grids and High-Impedance Surfaces Comprising Metal Strips or Patches," by O. Luukkonen, C. Simovski, G. Granet, G. Goussetis, D. Lioubtchenko, A. Raisanen, and S. Tretyakov, in *IEEE Antennas and Propagation*, Vol. 56, No. 6, 1624, (2008), the authors suggest an analytical model capable of predicting the plane-wave response of artificial surfaces for large angles of incidence, including of TE- and TM-polarized waves. While the authors discuss the conduct of the waves on the artificial surfaces, they do not discuss the conversion of the polarization modes or employ mechanisms to alter the polarized waves on the artificial surfaces.

In other prior art, "Adaptive Artificial Impedance Surface Conformal Antennas," by J. Colburn, A. Lai, D. Sievenpiper, A. Bekaryan, B. Fong, J. Ottusch, and P. Tulythan, in *Antennas and Propagation Society International Symposium,* 1, (2009), discloses an approach to controlling the radiation from surface waves propagating on an adaptable impedance surface wherein varactors are inserted between small metal pads. By varying the voltage bias between the metal pads, different impedance patterns can be created allowing the antenna to be sufficiently agile to make conformal antennas that are adaptable both in frequency and radiation pattern. In addition microwave holograms are created using the interference pattern between the expected bound TM surface wave and the desired outgoing plane wave. No polarization conversion is suggested or disclosed.

In B. Fong, J. Colburn, J. Ottusch, J. Visher, and D. Sievenpiper, "Scalar and Tensor Holographic Artificial Impedance Surfaces," *IEEE Transactions On Antennas And Propagation*, Vol. 58, No. 10, 3212 (2010), this prior art discloses TM and TM-like holographic antennas. In FIG. 1, a tensor artificial impedance surface, implementing a slice through square metal patches having a variable angle and gap width, are used to design conformal antennas to scatter a given surface wave into a desired far-field radiation pattern and provide polarization control. This prior art discloses means to design and build a surface to generate a circularly polarized plane wave from a linearly polarized source. However, this prior art does not disclose a structure or method to convert the polarization of surface waves between pure TE and TM polarizations.

In D. Gregoire and J. Colburn, "Artificial Impedance Surface Antennas," *Proceedings of the* 2011 *Antenna Applications Symposium,* 460 (2011), the prior art identifies structures that support surface waves that are polarized in either transverse electric (TE) or transverse magnetic (TM) modes. In FIG. 2, the authors report a square patch, with an angled slice through it, has been used to form tensor surface wave structures, in order to realize holographic leaky-wave antennas with circularly polarized radiation.

In A. Patel and A Grbic, "A Printed Leaky-Wave Antenna Based on a Sinusoidally-Modulated Reactance Surface," *IEEE Transactions on Antennas and Propagation*, Vol. 59, No. 6, 2087, (2011), this prior art provides for designing a reactance surface that generates directive radiation at a desired off-broadside angle for a fixed frequency. In particular a printed leaky wave, TM polarized antenna with a modulated reactance surface is designed using an array of metallic strips, with the gaps between metallic strips mapped to a desired surface impedance, over a grounded dielectric substrate. Neither use of TE polarization for this prior art reactance surface design nor conversion between TE and TM polarization are disclosed.

Tensor impedance surfaces have a tensor relationship between the electric and magnetic fields on the surface. This relationship is defined by the 2×2 surface impedance tensor:

$$Z_{surf} = \begin{bmatrix} Z_{xx} & Z_{xy} \\ Z_{yx} & Z_{yy} \end{bmatrix},$$

$$E = Z_{surf}(\hat{z} \times H).$$

Impedance surfaces are most commonly created by periodically patterning sub-wavelength metallic inclusions into a dielectric. The periodicity of the inclusions are generally on the order of λ/10. For larger periods, surfaces support multiple surface wave modes which can interfere. The TM-like mode breaks down at the cutoff of the lowest TE mode. Above this cutoff frequency the TM-like mode can no longer be used for certain incidence angles. In prior art designs, the antenna is operated below this TE cutoff frequency. In the present invention it is shown that a polarization converter can be created by operating above the TE cutoff frequency. The mode is not a TM-like mode but instead a true hybrid TM-TE mode. Hybrid TM-TE modes are not correctly modeled by a single tensor impedance boundary. Instead, a grounded dielectric with a tensor impedance sheet on the top layer is used to model the structure. Extraction methods for capacitive impedance sheets on grounded dielectric substrates have been developed.

The main advantage of the present invention is that it allows a designer to switch between polarizations within a single design. It can also alter (either increase or decrease) coupling between antennas or objects on a surface.

BRIEF DESCRIPTION OF THE INVENTION

In one aspect the present invention provides an apparatus for converting an applied surface bound electro-magnetic wave from one linear combination of surface bound electromagnetic modes to a different linear combination of surface bound electromagnetic modes, the apparatus comprising: a dielectric surface having an anisotropic impedance tensor when the frequency of the applied surface bound electro-magnetic wave is equal to or greater than a TE mode cutoff frequency corresponding to a second solution of Maxwell's equations for said dielectric surface.

In another aspect the present invention provides an apparatus for converting electro-magnetic surface waves from TE mode to TM mode or from TM mode to TE mode comprising: dielectric surface; and a plurality of electrically conductive unit cells disposed on said dielectric surface and arranged in a two dimensional array of unit cells, a majority of the unit cells in said array being divided into at least two portions, with at least one gap separating the at least two portions from each other into two or more patches or plates, the array of unit cells having a surface wave input end and a surface wave output end, gaps in the unit cells disposed closest to the surface wave input end having a first orientation and gaps in said unit cells disposed closest to the surface wave output end having a second orientation different than said first orientation.

In still another aspect the present invention provides an apparatus for converting an electromagnetic surface wave from TE mode to TM mode or from TM mode to TE mode or from one linear combination of TE and TM modes to a different linear combination of TE and TM modes, the apparatus comprising: dielectric surface having an anisotropic impedance surface with the frequency of operation of the dielectric surface being greater that a TE cutoff frequency corresponding to a second solution of Maxwell' equations for said dielectric surface.

In yet another aspect the present invention provides a method of converting a surface bound electromagnetic wave from a first surface bound mode to a second surface bound mode comprising: electromagnetically coupling a surface bound electromagnetic wave to an input end of an electromagnetic transport medium comprising a plurality of unit cells disposed in an array of said cells, a majority of the unit cells being separated into a pair of patches or plates which are separated by from each other by a linear slice or gap having a predetermined orientation for each said unit cell in said array of unit cells; and arranging the unit cells in said array such that the orientation of the linear slice or gap of units cell disposed in between said input and said output electromagnetic transport medium changes from unit cell to unit cell as the surface bound electromagnetic wave moves from unit cell to unit cell towards the output of the electromagnetic transport medium.

BRIEF DESCRIPTION OF THE DRAWINGS

FIG. 1*b* illustrates slice rotations for cells within a matrix of the present invention while

FIG. 3*a* is drawn to scale and the size of the matrix of square patches is shown in mm along the vertical axis (with values from 5 mm to 30 mm) and along the horizontal axis with values from 10 mm to 70 mm).

FIG. 4-5 depicts a portion of the fabricated polarization converter of FIGS. 4-1 thru 4-4 and Appendix A.

FIG. 5 shows an illustration of the unit cell and its approximation using a tensor impedance sheet in place of the conductive patches.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The present invention discloses an electromagnetic transport medium or surface which can convert the polarization of surface bound waves between pure TE and TM polarizations, for example. The electromagnetic transport medium or surface is created by patterning metallic patches or plates 10 disposed on one major surface of a dielectric substrate 12. In the preferred embodiments, the dielectric substrate has a ground plane 14 disposed on its other (opposing) major surface.

Figure 1A:
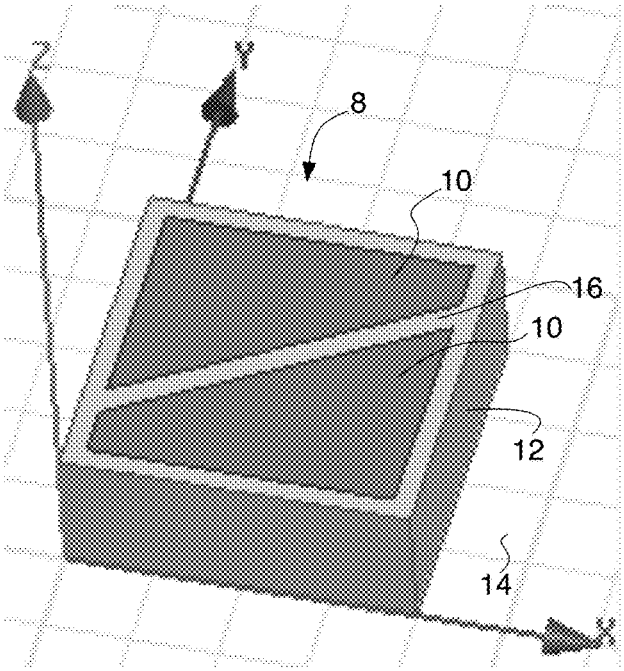
FIG. 1*a* illustrates a perspective view of the square patch unit cell of the present invention.

The patches or plates 10 preferably utilize a sliced unit cell arrangement that was first presented in "Scalar and Tensor Holographic Artificial Impedance Surfaces," by B. Fong, J. Colburn, J. Ottusch, J. Visher, and D. Sievenpiper in *IEEE Transactions On Antennas And Propagation*, Vol. 58, No. 10, 3212 (2010). FIG. 1*a* is an illustration of the unit cell 8. The unit cell 8 structure is preferably formed from a printed circuit material 12, such as Rogers 5880, which has a dielectric constant of $\varepsilon r=2.2\ \varepsilon_0$ which also corresponds to its relative permittivity. The dielectric substrate 12 has metal on one major surface thereof which preferably forms the ground plane 14 while the metal on the opposing surface of the printed circuit material is patterned to form a plurality of unit cells 8 (see also FIG. 3*a* and/or FIG. 3*b* and Appendix A). Each unit cell 8 is preferably square (but not necessarily so, see FIGS. 8*a*-8*g*) with side dimensions (along the x and y axes depicted by FIG. 1*a*) of about 4 mm when the frequencies of interest are in the 13.5 to 20 GHz range, and the gap 16 of the slice between the metal patches or plates 10 of a unit cell 8 may be about 0.3 mm, for example. The dimensions of unit cell 8 can be scaled up or down to allow the disclosed invention to operate in other frequency ranges as will be discussed with reference to FIGS. 2*b* and 2*c*. Also, as will be subsequently discussed with reference to FIGS. 8*a*-8*g*, the unit cells 8 need not be necessarily a square shape as other geometric shapes should also work.

The height h of the printed circuit board (see FIG. 1*c*) is represented by the z-axis in FIG. 1*a*. The dielectric substrate 12 can be seen in the slice defining gap 16 between the two patches or plates 10 depicted by FIG. 1*a*. Many unit cells 8 are utilized together and the width of the spacing or gap 17 between neighboring unit cells 8 may conveniently be the same as the width of the gap 16 in the slice between the patches or plates 10 of a unit cell 8, but it is not necessary that the size of spacing 17 be the same as the size of gaps 16. As such, in some embodiments, each unit cell 8 is spaced from a neighboring unit cell in said array by a first distance (see spacing or gap 17) and wherein said gap or gaps 16 are equal to a second (different) distance. In other embodiments, the first distance (see spacing or gap 17) may conveniently be the same as the width of the gap 16 in the slice between the patches or plates 10 of a unit cell 8.

TM-like modes are supported by this structure at lower frequencies. Above a TE cutoff frequency, TM-like modes are no longer supported but rather Hybrid TM-TE modes are supported instead.

Figure 2A:
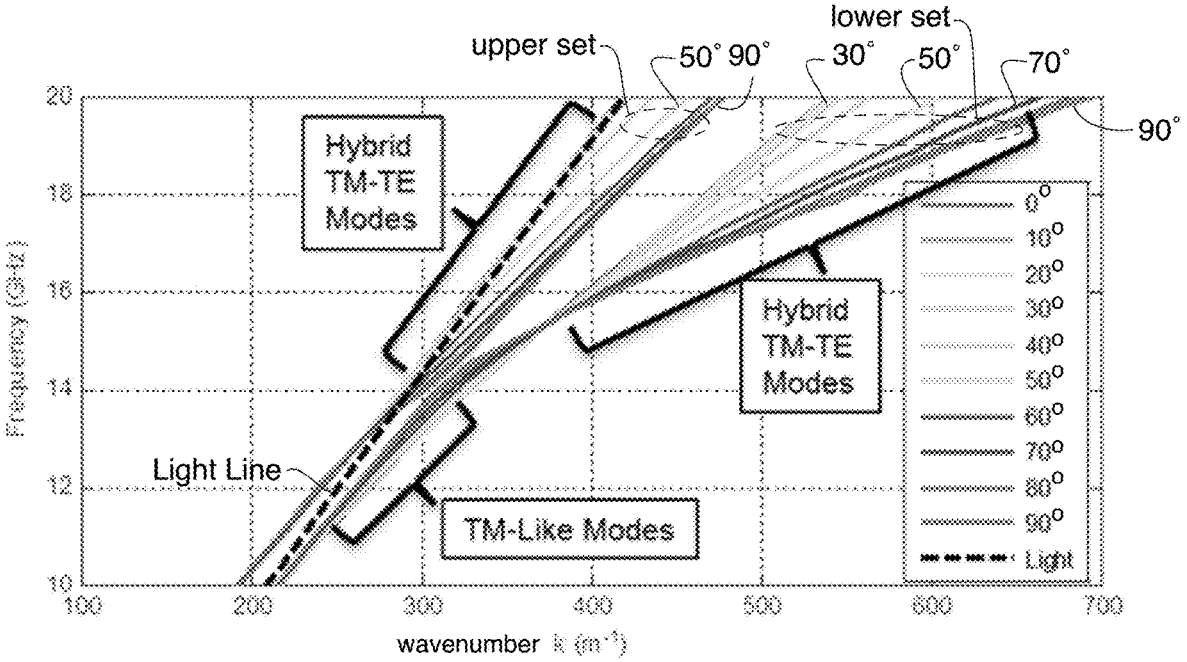
FIG. 2*a* is a dispersion graph of unit cell for multiple slice rotations with each curve representing a different slice angle and two mode plotted for each slice angle through a unit cell wherein the unit cells are sized so that the cutoff frequency corresponds to a wavenumber k of approximately 300.

FIG. 2*a* is a dispersion diagram for a unit cell sized in accordance with the preferred embodiment, which a unit cell size equal to about $1/5^{th}$ wavelength on a side thereof (given a dielectric constant of 2.2 for the substrate material 12), where the wavelength is the wavelength of the supported surface bound Hybrid TM-TE mode waves. So, in this embodiment, the cell size equals 4 mm on a side thereof as mentioned above while utilizing a substrate 12 having a relative permittivity or dielectric constant of 2.2. The frequencies of interest are in the 13.5 to 20 GHz range as can be seen from FIG. 2*a*. The light line corresponds to the speed of light in a vacuum.

Figure 2B:
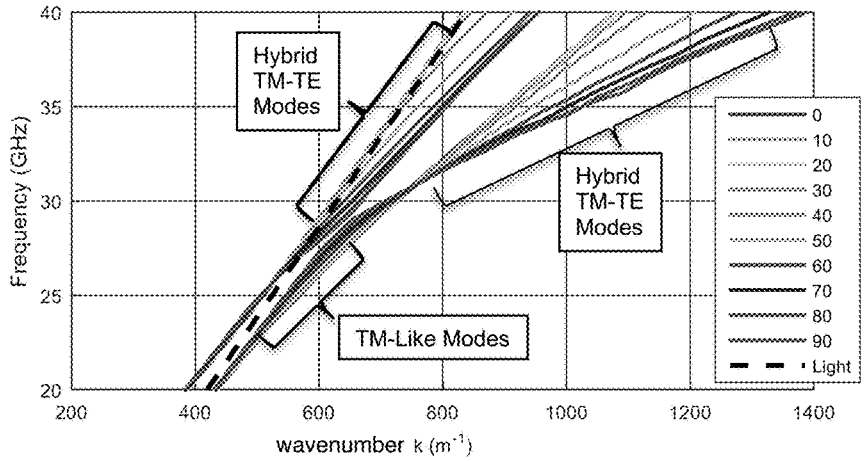
FIGS. 2*b* and 2*c* are similar to FIG. 2*a*, but the unit cells are sized so that the cutoff frequency corresponds to a wavenumber k of approximately 150 (see FIG. 2*b*) or 600 (see FIG. 2*c*).

FIG. 2*b* is a dispersion diagram for an embodiment having a unit cell half as big as the preferred embodiment and thus having a unit cell size of 2 mm on a side thereof, which is again about $1/5^{th}$ wavelength on a side thereof for the wavelengths of interest for this embodiment (and assuming a relative permittivity or dielectric constant of 2.2 for substrate 12) which corresponds to surface bound Hybrid TM-TE mode waves having frequencies falling in the range 27 to >40 GHz). So the aforementioned TE cutoff frequency is about 27 GHz for this embodiment.

Figure 2C:
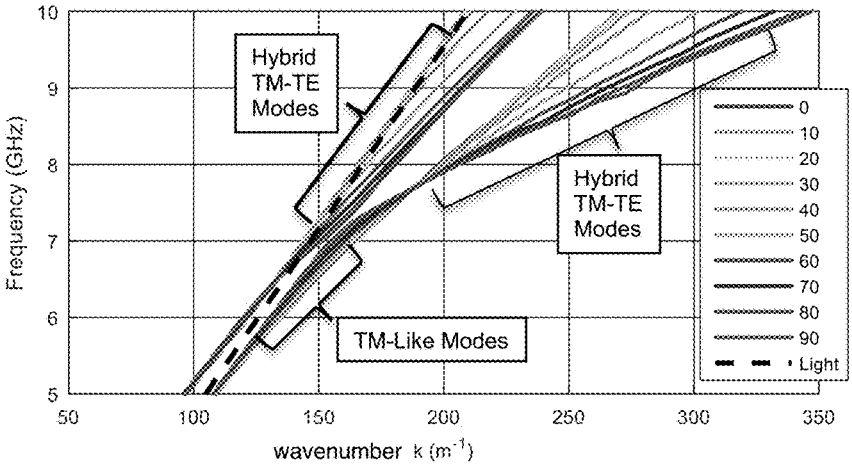

FIG. 2*c* is a dispersion diagram for an embodiment having a unit cell twice as big as the preferred embodiment (and thus having a unit cell size of 8 mm on a side thereof—again equal to $1/5^{th}$ of a wavelength on a side thereof for the wavelengths of interest for this embodiment (and assuming a relative permittivity or dielectric constant of 2.2 for substrate 12 of course) which embodiment correspond to surface bound Hybrid TM-TE mode waves having frequencies falling in the range 7 to >10 GHz). So the aforementioned TE cutoff frequency is about 7 GHz for this embodiment.

FIGS. 2*b* and 2*c* both assume that the permittivity of the substrate is unchanged from that of FIG. 2*a*. In general, if the permittivity of the substrate is changed, it should be noted that the cutoff frequency between the TM-like mode and the desired Hybrid TM-TE is related to the square root of the relative permittivity or dielectric constant of the dielectric substrate 12. And using a material with a substantially different relative permittivity or dielectric constant than the relative permittivity or dielectric constant of 2.2 associated with the preferred substrate material will cause the sizes of the unit cells to be different than the $1/5^{th}$ of a wavelength used in the embodiments discussed herein.

FIGS. 2*a*-2*c* clearly demonstrate that the size of the unit cells can be adjusted to fix the TE cutoff frequency where TM-like modes are no longer supported but rather Hybrid TM-TE modes are supported instead at some desired frequency range.

It should also be noted at this point that the TE cutoff frequency is the frequency at which the TM-like modes are no longer supported and the Hybrid TM-TE modes start to become supported. So for an embodiment whose dispersion diagram corresponds to FIG. 2*a*, while the Hybrid TM-TE mode starts being supported at about 13.5 GHz, the best support for the Hybrid TM-TE mode electromagnetic waves seems to occur at about 17 GHz (which is about 20% higher than the TE cutoff frequency according to a second solution of Maxwell's equations).

Figure 1B:
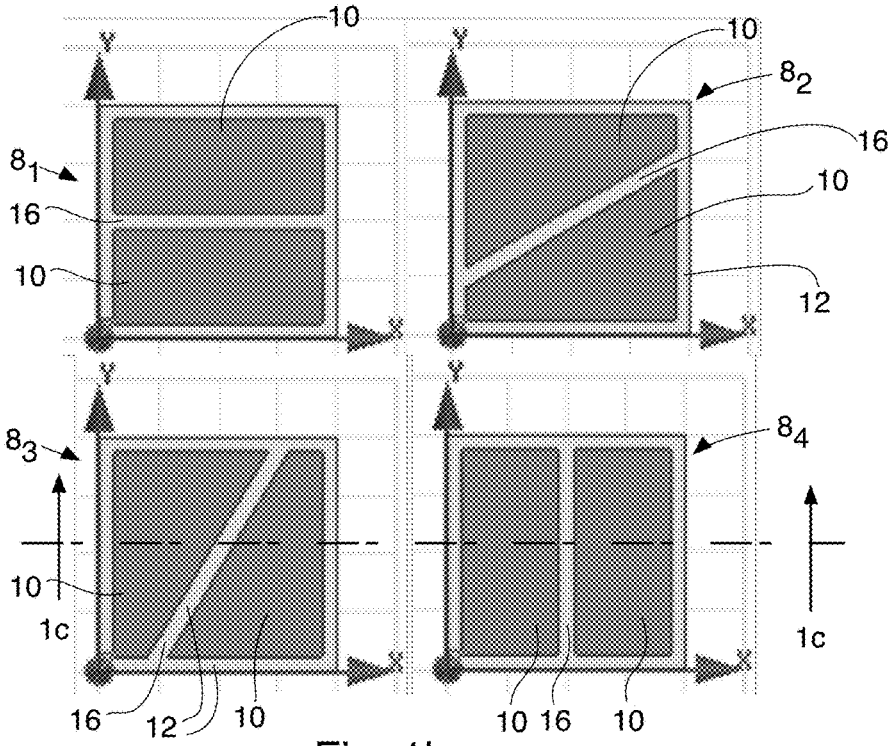
Figure 1C:
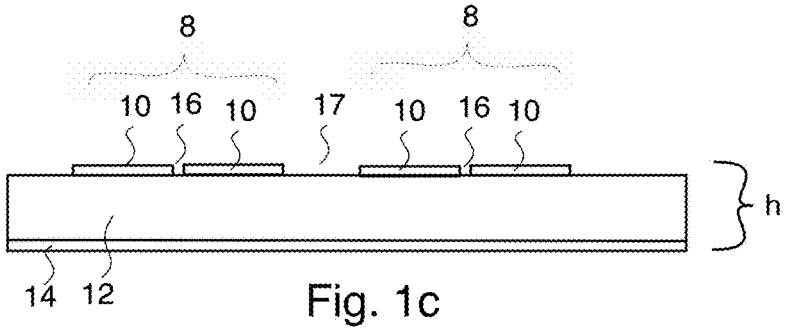
FIG. 1*c* depicts a sectional view taken along line 1*c*-1*c* of FIG. 1*b*.

FIG. 1*b* shows four unit cells 8 identified here as cells $\mathbf{8}_1$-$\mathbf{8}_4$. The slice (defined by gap 16) of each cells $\mathbf{8}_1$-$\mathbf{8}_4$ is linear and disposed at a different angle with each unit cell $\mathbf{8}_1$-$\mathbf{8}_4$ so the angle of the slices (defined by gaps 16) effectively changes or rotates from a horizontal position (as viewed in the figure) for cell $\mathbf{8}_1$ to a slightly counterclockwise position for cell $\mathbf{8}_2$. In cell $\mathbf{8}_3$, the slice (defined by gap 16) has rotated still further and then the slice arrives in a vertical orientation (again as as viewed in the figure) at cell $\mathbf{8}_4$. So in FIG. 1*b*, the slice (defined by gap 16) rotation from 0 degrees (cell $\mathbf{8}_1$) to 90 degrees (cell $\mathbf{8}_4$) occurs in four stages. In practical embodiments, the slice rotation typically occurs over many more stages (unit cells 8) and the unit cells 8 are typically more closely spaced to each other. The unit cells $\mathbf{8}_1$-$\mathbf{8}_4$ of FIG. 1*b* are depicted more widely spaced or separated for ease of illustration and only a few unit cells 8 are depicted for ease of illustration. Also, as will be seen, the unit cells 8 are typically arranged in rows and columns, with the slice rotation angle varying in a row while all unit cells in a column of same typically have the same amount of slice rotation.

Eigenmode unit cell simulations were performed for multiple slice angles. Eigenmode simulations assume an infinite lattice of unit cells 8. As is shown in FIGS. 2*a*-2*c*, modes above the light line (as represented by the dashed line) are leaky and radiate away from the surface with the patches or plates 12 while modes below the light line remain bound to that surface. The TE cutoff is at about 13.5 GHz for the chosen unit cell dimensions (represented by FIG. 2*a*) and substrate permittivity, and below this frequency TM-like modes are supported. Above the cutoff hybrid TM-TE modes are supported.

All known prior art structures make use of the TM-like mode (below the cutoff frequency). The TM-like mode (which correspond to a first solution of Maxwell's equations) is defined as the lowest frequency mode that exists from zero frequency (DC) up to the TE cutoff frequency for unit cells consisting of a grounded dielectric substrate with metal patch inclusions or patches (unit cells) on the top layer thereof. Note that this mode (solution one) may also be known by other names. However, electromagnetic structures support multiple modes because Maxwell's equations can have multiple solutions (resulting in multiple modes of operation) for a given set of boundary conditions. These different modes have different frequency bandwidths within they are valid and different field polarizations. The cutoff is the frequency at the edge of valid bandwidth. In the preferred embodiment disclosed herein (whose dispersion diagram is represented by FIG. 2*a*), a TM-like mode (mode one) is supported from 0-13.5 GHz where 13.5 GHz is the cutoff frequency. However, this invention does not utilize that mode (corresponding to solution one of Maxwell's equations) which corresponds to 0-13.5 GHz frequency range for the preferred embodiment (whose dispersion diagram is represented by FIG. 2*a*). What is of interest to the present invention is the next mode (called the Hybrid TM-TE mode mentioned herein) which corresponds to a second solution of Maxwell's equations and which occurs from 13.5 GHz to at least 20 GHz for the preferred embodiment (whose dispersion diagram is represented by FIG. 2*a*).

FIGS. 2*a*-2*c* are based on a mathematical simulation of the surface. Since the limit of the testing equipment used to verify the present invention was limited to 20 GHz, the simulation only went to 20 GHz when FIG. 2*a* was prepared. At some frequency greater than 20 GHz, a next cutoff frequency would be encountered (probably around 30 GHz). A third mode exists from perhaps 30 GHz up to some third (still higher) cutoff frequency for the embodiment of FIG. 2*a*. That third mode and higher yet modes have not been investigated as yet, but they too could potentially prove to be useful to the present invention. FIGS. 2*b* and 2*c* are based on an extrapolation of FIG. 2*a* data since there is a linear relationship between frequency and wavenumber for a given value of the speed of light c.

The approximate value of 13.5 GHz is the TE cutoff frequency which results from a second solution of Maxwell's equations for the preferred embodiment disclosed herein (corresponding to the dispersion diagram of FIG. 2*a*). Solutions to Maxwell's equations depend upon multiple factors including the period size (wavenumber) of the patches, material properties of the substrate (mostly its permittivity), and patch geometry (to a lesser extent than the other two factors just mentioned). Scaling the dimensions of the unit cell 8 (corresponding to a patch) affects the period size of the patches (and hence the wavenumber) and therefore the cutoff frequency may be located at any frequency desired by such scaling (it being noted that changing the permittivity of the substrate also has an effect on the TE cutoff frequency).

In the preferred embodiment disclosed herein (corresponding to the dispersion diagram of FIG. 2*a*), a Hybrid TM-TE mode (solution two of Maxwell's equations) is supported from approximately 13.5 to >20 GHz as seen in FIG. 2*a*. The anisotropy of the conductive patches establishes the Hybrid TM-TE mode unlike isotropic conductive patches, which would support two independent modes (one TE and one TM). No prior art of which the inventor is aware has used this Hybrid TM-TE mode (solution two of Maxwell's equations), and it is this mode which allows for the polarization conversion of bound surface waves of the present invention.

The novel surface wave polarization converter of the present invention utilizes the Hybrid TM-TE mode discussed herein. However, it will be noted that there are two sets of Hybrid TM-TE modes depicted by FIGS. 2*a*-2*c* and these two sets are specifically identified as and "upper set" and "lower set" on FIG. 2*a*. The separation into upper and lower sets can also be seen in FIGS. 2*b* and 2*c* even though they are not specifically labeled as such on those figures. Either set could, in theory, be used for polarization conversion. But, the upper set, results in leaky waves as opposed to surface bound waves, so in practice if the disclosed device were used in that regime (corresponding to the upper set), the device would act as an antenna as opposed to a surface wave polarization converter which is the desired end result of this present invention. In order to keep the electromagnetic waves surface bound the lower set is utilized, but the upper set still does a conversion from TM to TE. Higher-order modes (defined by cutoff frequencies corresponding to third and greater solutions of Maxwell's equations) at higher frequencies can also likely be used, but those higher order modes have not yet been investigated.

The lower set of modes depicted by FIGS. 2*a*-2*c* converts between a bound TM mode with the slice angle at 0 degrees to a bound TE mode with a slice angle at 90 degrees. See FIG. 3*a*. If a surface bound TM mode electromagnetic wave having a frequency above the TE cutoff frequency is applied to forward end (on the left hand side of the figure where the slice angle is 0 degrees) the surface of FIG. 3*a*, a surface bound TE mode electromagnetic of the same frequency occurs at the reverse end the surface of FIG. 3*a* where the slice angle is at 90 degrees. The conversion occurs by gradually rotating the slice (defined by gap 16) from 0 to 90 degrees through a series of unit cells 8 from left to right over distance A. The embodiment of FIG. 3*a* has 0.4 mm sized unit cells 8 and the surface is assumed to have a dielectric constant of 2.2, so the TE cutoff frequency is 13.5 GHz for this embodiment. That can be changed by either or both (i) changing the dielectric material 12 to have a different dielectric constant than 2.2 and/or (ii) changing the pitch size of the unit cells 8 from 0.4 mm.

Figure 3A:
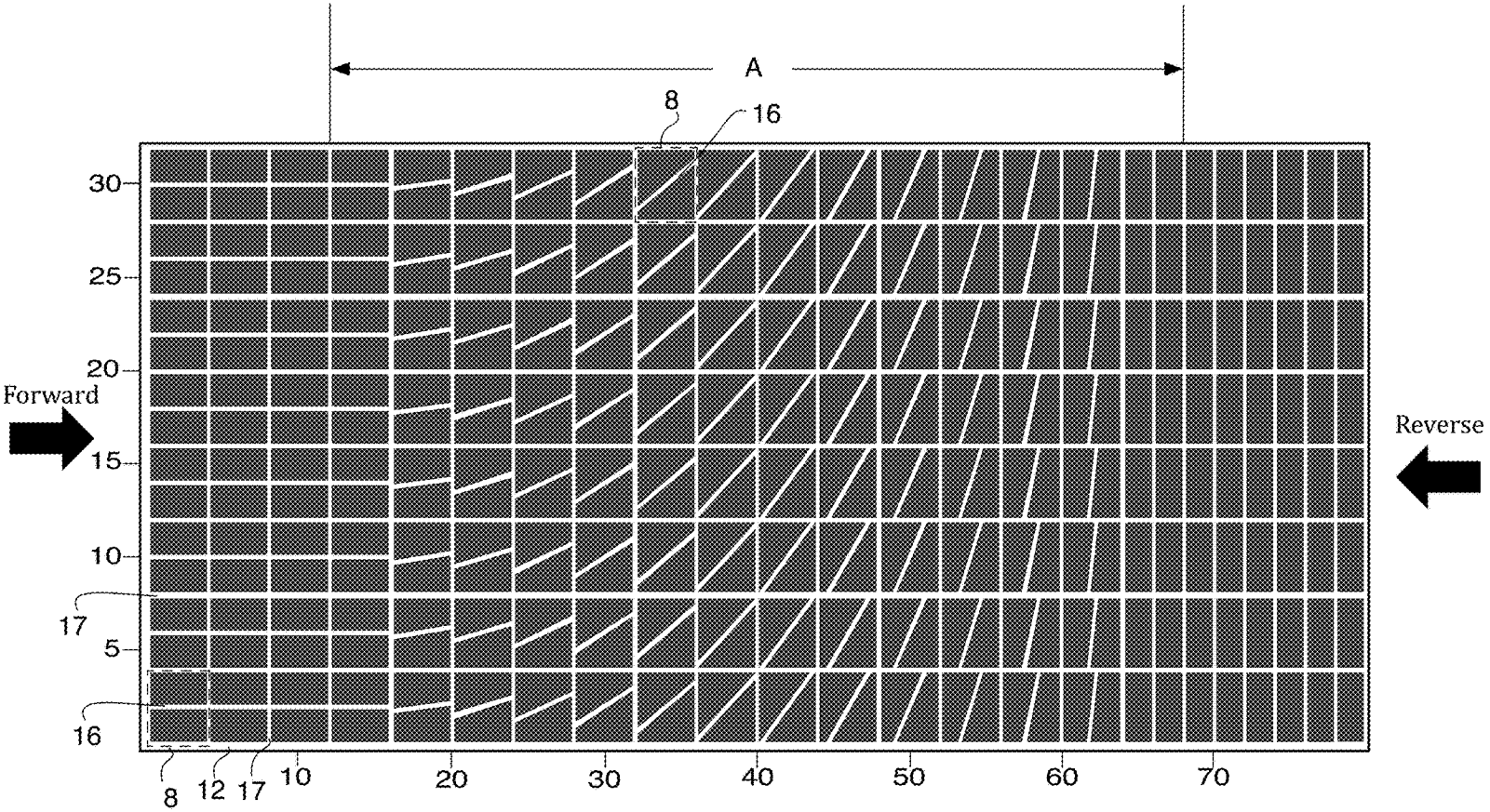
FIGS. 3*a* and 3*b* illustrate different embodiments of a matrix of square patches of the electromagnetic transport medium wherein slices through matrix of square patches are rotated gradually from a first direction to a second direction as a surface bound TM or TE wave encounters the matrix of square patches changing the polarization a surface bound TM wave to a surface bound TE or changing the polarization a surface bound TE wave to a surface bound TM wave.

The embodiment of FIG. 3*a* will convert a surface bound TE mode electromagnetic wave applied to the reverse end of the surface of FIG. 3*a* to surface bound TM mode wave which will appear at the forward end of the surface of FIG. 3*a*, assuming that the frequency of the applied surface bound TE mode electromagnetic wave is greater than the TE cutoff frequency of 13.5 GHz for this particular embodiment. The surface of FIG. 3*a* has 0.4 mm sized unit cells 8 and the surface is assumed to have a dielectric constant of 2.2, so the TE cutoff frequency is 13.5 GHz for this embodiment. That can be changed by either or both (i) changing the dielectric material 12 to have a different dielectric constant than 2.2 and/or (ii) changing the pitch size of the unit cells 8 from 0.4 mm.

The upper set of TM-TE modes occurs when a TM mode electromagnetic wave encounters slices at 90 degrees instead of slices at 0 degrees, so the TM mode electromagnetic wave is being then applied to the reverse end shown in FIG. 3*a* instead of the forward end. In that case, the electromagnetic wave immediately starts to leak. The surface is then acting as an antenna which is not what is desired for the present invention. Similarly, when a TE mode electromagnetic wave encounters slices at 0 degrees instead of slices at 90 degrees because the TE mode electromagnetic wave is being applied to the forward end shown in FIG. 3*a* instead of the reverse end, the applied electromagnetic wave immediately starts to leak. The surface is then again acting as an antenna which is not what is desired for the present invention.

Figure 3B:
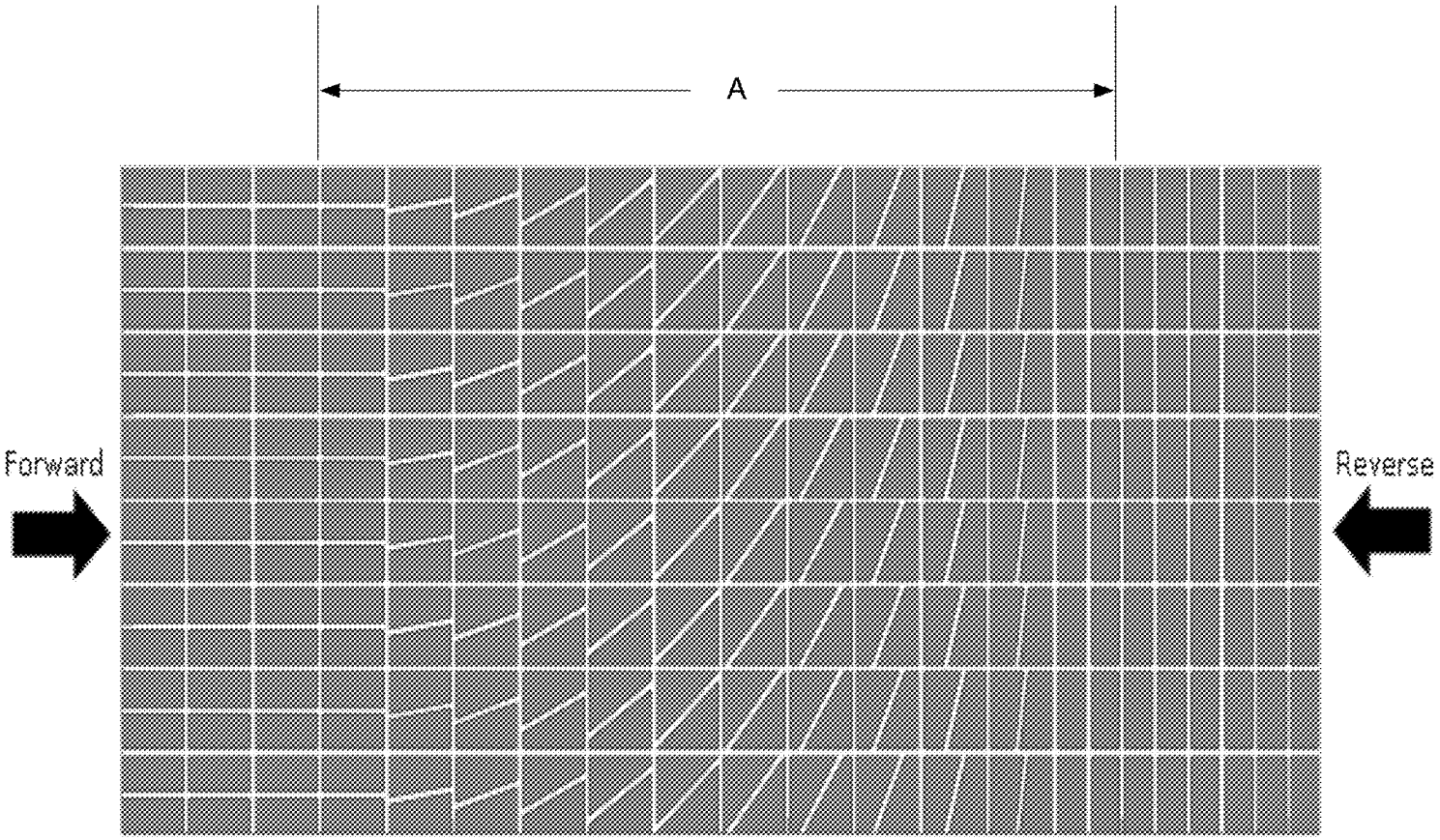

Exemplary structures of the present invention are illustrated in FIGS. 3*a* and 3*b* which are plan views of two different arrays of unit cells 8 each having a slice (defined by gap 16) wherein the angle of the slice gradually changes from 0 degrees (horizontal in these plan views) to 90 degrees (vertical in these plan views) across the array of unit cells 8. In the embodiment of FIG. 3*a*, a matrix of 20×8 unit cells 8 is depicted with each cell having a single slice (defined by gap 16). The angle of the slices gradually transition from 0 degrees to 90 degrees over a length (or series) A of 14 unit cells 8 or stages. In the embodiment of FIG. 3*b*, a matrix of 18×8 unit cells 8 is depicted with each cell having a single slice (defined by gap 16). The angle of the slices gradually transitions from 0 degrees to 90 degrees over a length A of 12 cells 8 or stages in the embodiment of FIG. 3*b*. So the transitioning of the slices (defined by gap 16) from 0 degrees to 90 degrees in the embodiment of FIG. 3*b* occurs slightly more rapidly than in the embodiment of FIG. 3*a*.

Figure 4:
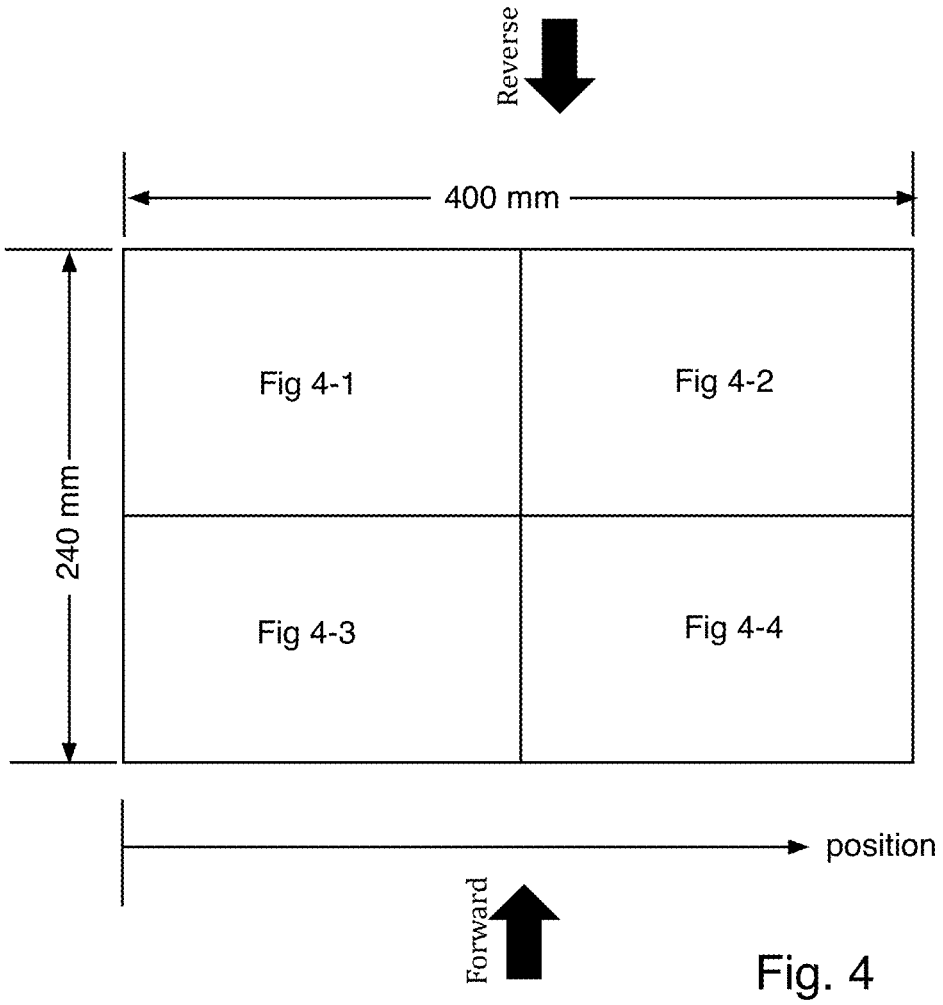
FIGS. 4-1 thru 4-4 may be re-assembled as shown by FIG. 4 as a larger drawing, which is a drawing of the fabricated polarization converter (see the photograph of Appendix A) which polarization converter has 60 rows by 1100 columns of unit cells.

The exemplary structures or embodiments of FIGS. 3*a* and 3*b* serve the purpose of showing how the angle of the slices (defined by gaps 16) gradually transition from 0 degrees to 90 degrees over a length A or series of unit cells 8 or stages. But actual embodiments may typically have many more unit cells 8. See FIGS. 4-4 thru 4-4, which when arranged as depicted by FIG. 4, form drawing of a matrix of 60×100 unit cells 8 which are disposed on a dielectric surface 12 (not shown in FIGS. 4-1 thru 4-4 for clarity of illustration). In this embodiment, the slices (defined by gaps 16) are rotated over a conversion region of thirty unit cells 8 at equal increments (three degrees per unit cell 8 in this embodiment). The rotation of the slices could also be performed using non-uniform increments. The amount of power which can be converted between TM and TE modes is improved by increasing the number units cells 8 or stages in the conversion region A. Using the lower set of TM-TE modes of FIGS. 2*a*-2*c*, the power conversion efficiency can be 90% or greater. The polarization converter preferably operates with conversion regions A (see FIGS. 3*a* and 3*b*) of approximately 0.5 wavelengths or greater length. In the embodiment of the polarization converter of FIGS. 4-1 thru 4-4, the conversion region is preferably six wavelengths long.

Rotating the principle axes of the impedance tensor by 90 degrees is what converts between pure TM surface bound modes and pure TE surface bound modes (or visa a versa depending on the direction of application of the surface bound wave as described about with reference to FIG. 3*a*). But rotation can also occur by angles other than 90 degrees, and these other angles would represent linear combinations of TM and TE surface bound modes. So, the conversion does not need to be between a pure TM surface bound mode or a pure TE surface bound mode, and can be between any linear combination of TM and TE surface bound modes to a different combination of TM and TE surface bound modes. In such a case, any rotation angle could be appropriate. The TM and TE modes are the extreme cases, but the technique disclosed herein utilizing the Hybrid TM-TE mode as disclosed herein can convert anywhere in between these extremes. So the slices depicted by FIGS. 3*a* and 3*b* could conceivably rotate through some angle less than 90° (but greater than zero degrees) if the conversion is not between pure TM or pure TE surface bound modes.

Consider the embodiment FIGS. 4-1 thru 4-4 again. FIGS. 4-3 and 4-4 shown the "forward" end where the slices have a 0 degree angle (as defined with reference to FIG. 3*a*). Recall that the first slice which a different angle is 3 degrees in this embodiment. If the slices of all of the unit cells were changed from 0 degrees to 3 degrees within region B depicted on FIGS. 4-3 and 4-4, then a surface bound electromagnetic wave applied at the forward end (see FIG. 4) could be a linear combination of a 97% TM and 3% TE surface bound electromagnetic wave. The surface bound electromagnetic wave exiting the reverse end (see FIG. 4) should then be a linear combination of a 0% TM and 100% TE (or pure TE) surface bound electromagnetic wave.

Applying a pure TE wave at the reverse end of such a modified embodiment should yield a linear combination of a 97% TM and 3% TE surface bound electromagnetic wave at the forward end of the surface.

Figures 1, 4:
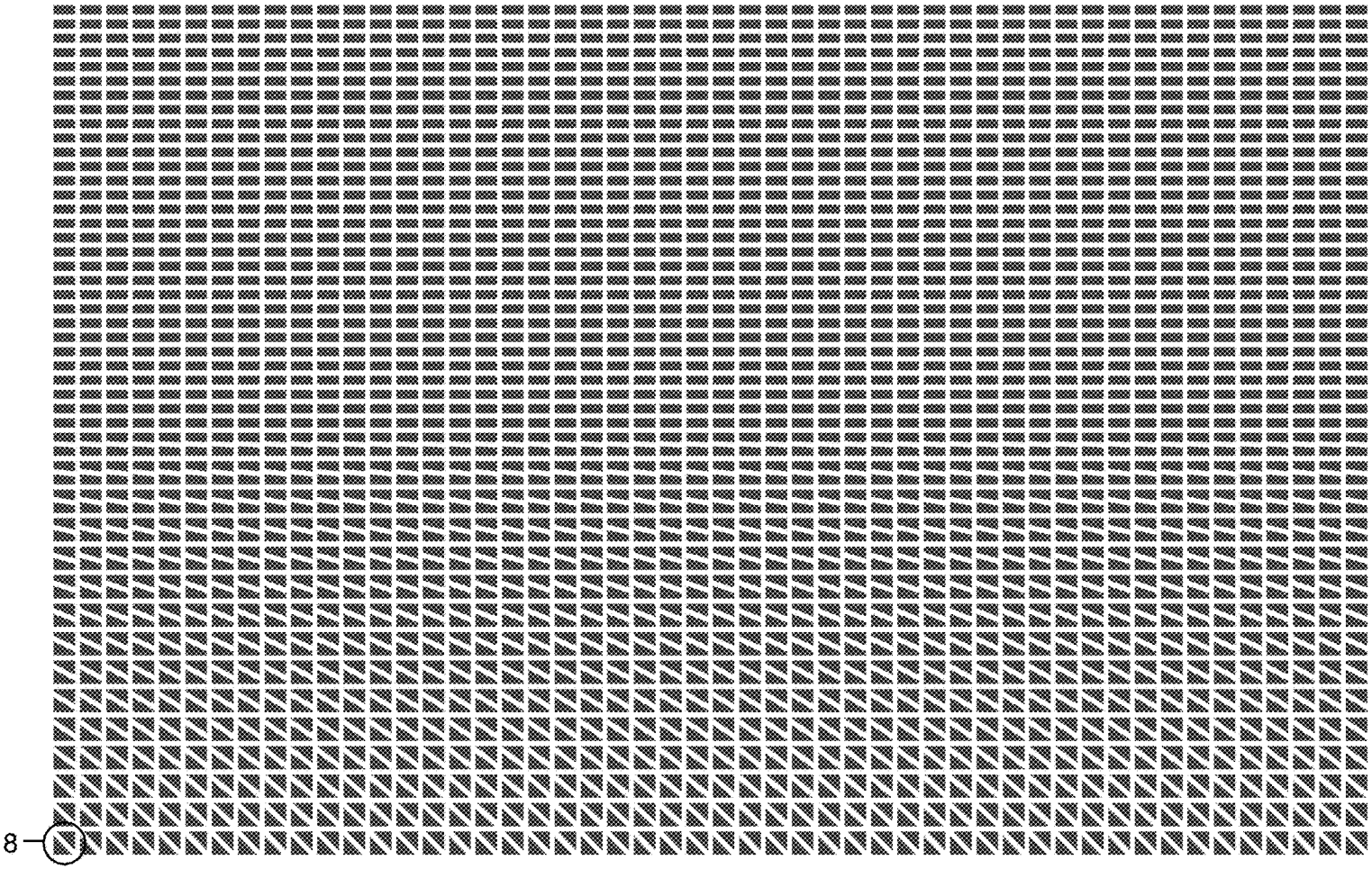
Figures 2, 4:
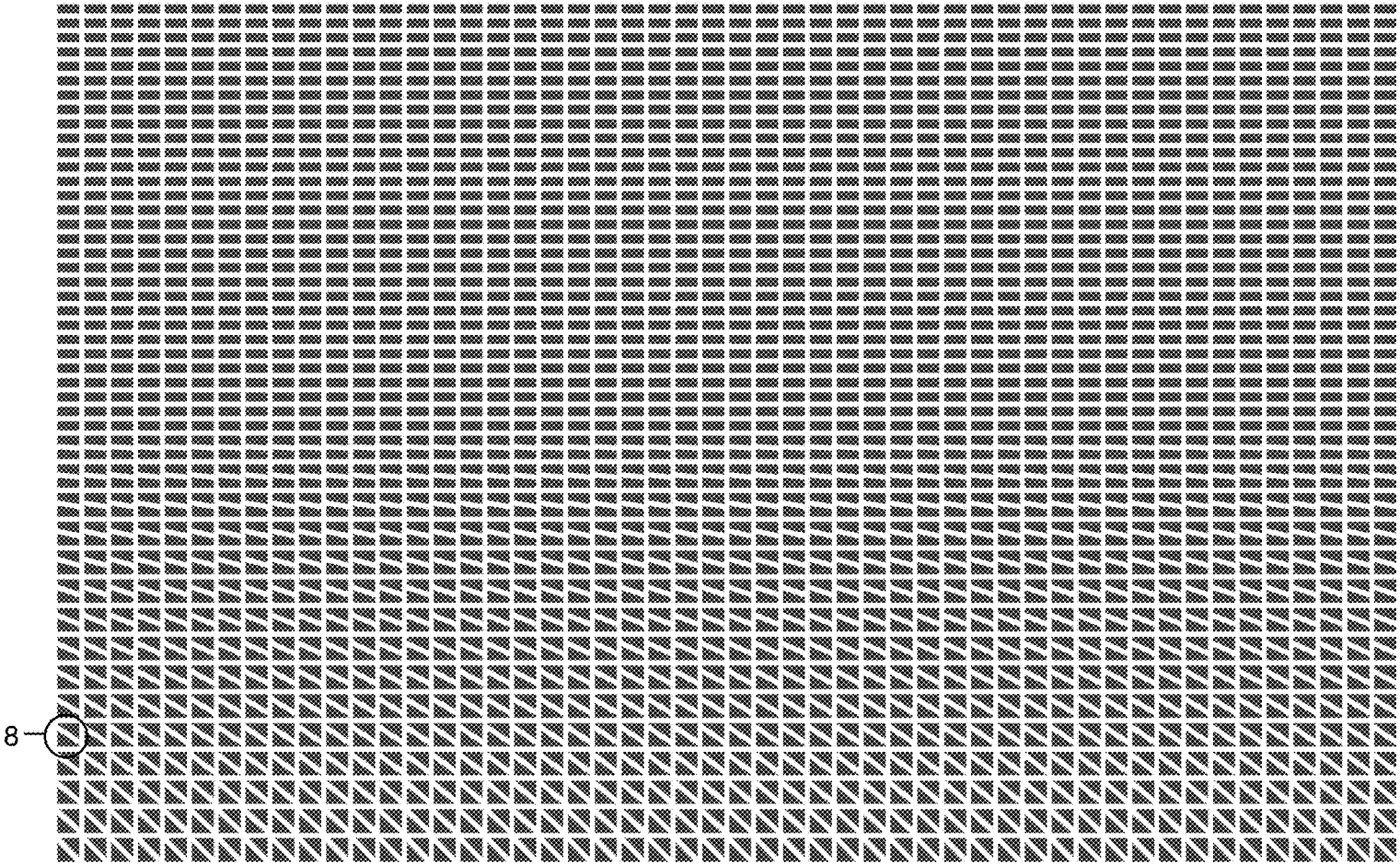
Figures 3, 4:
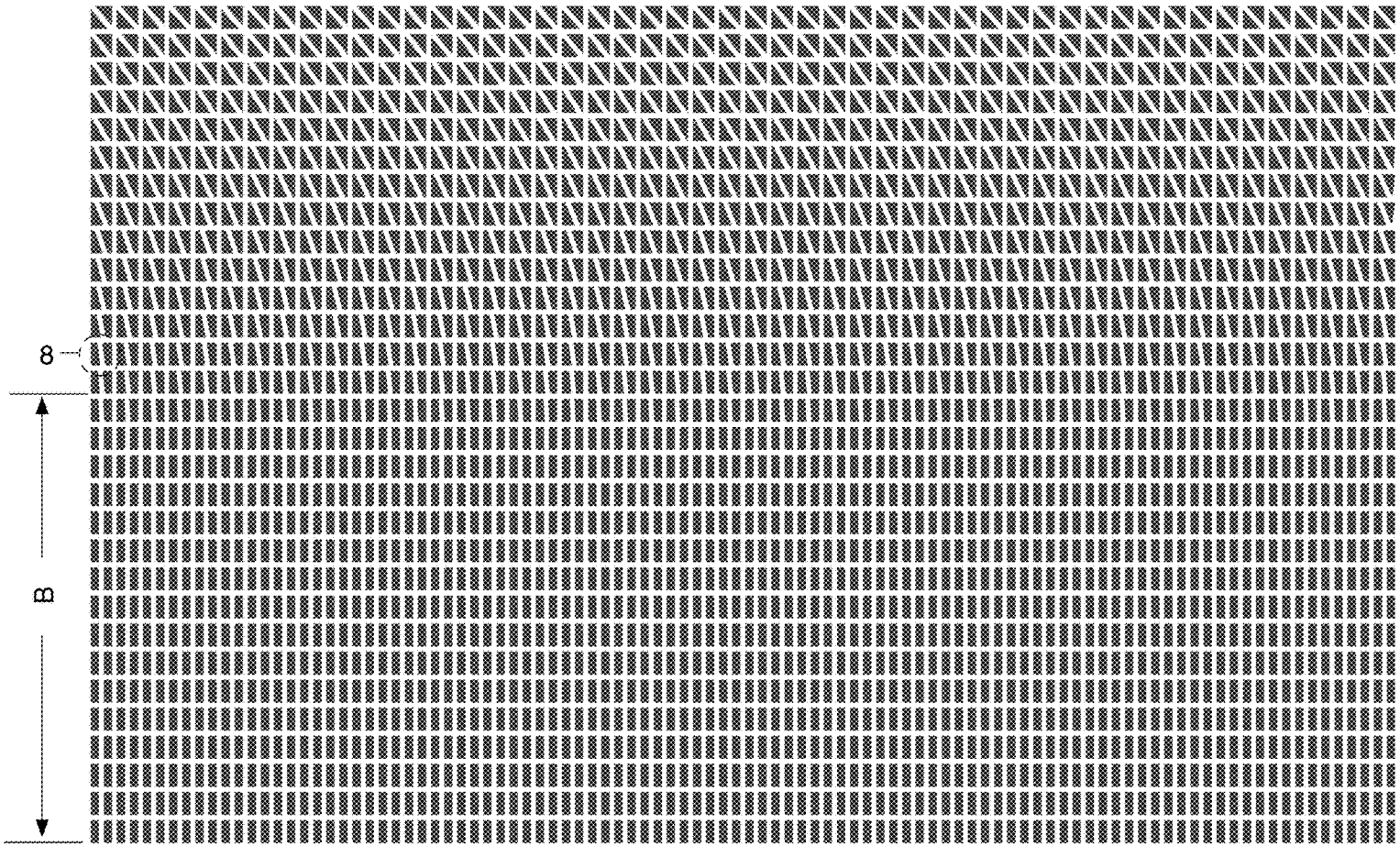
Figure 4:
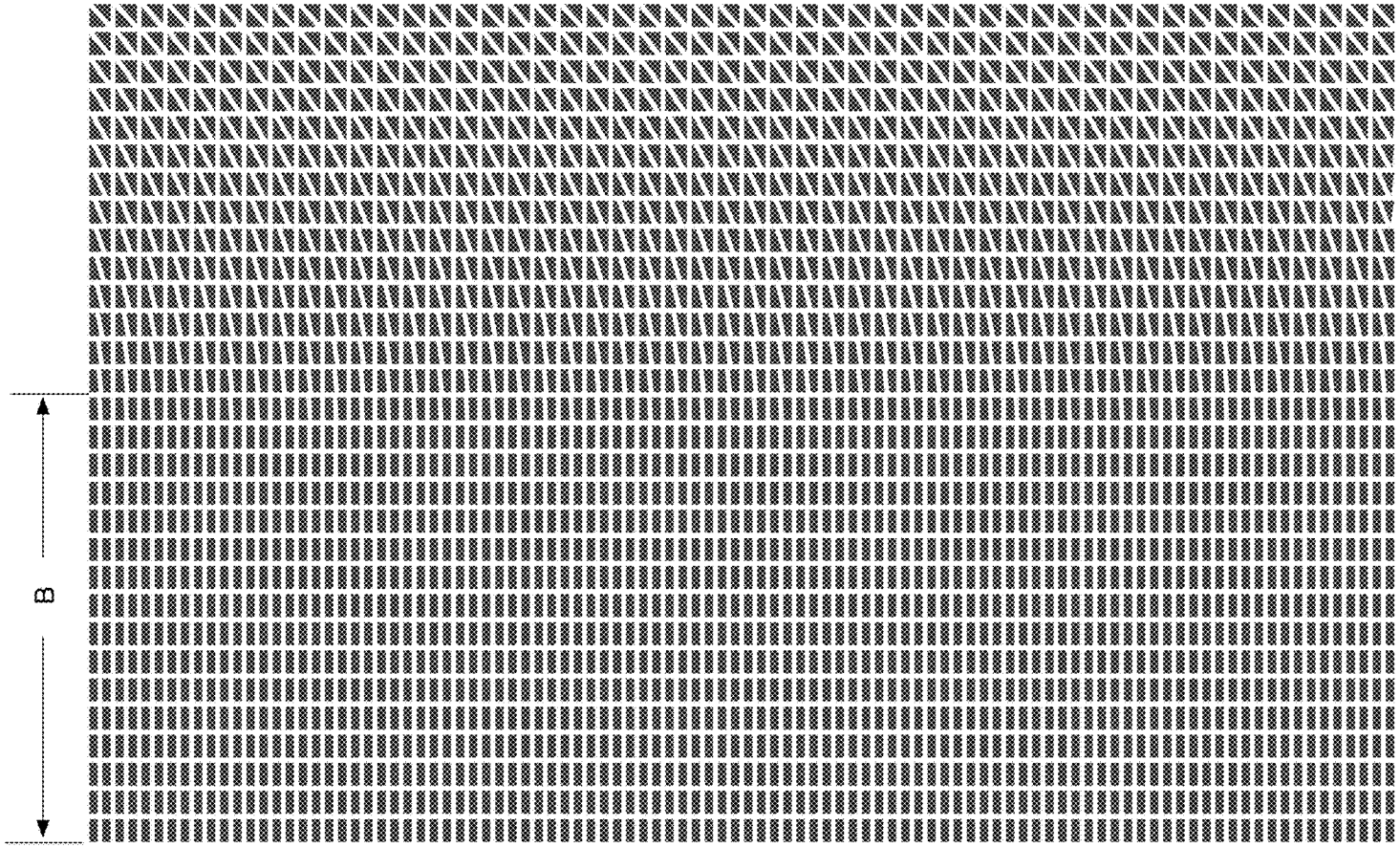

Appendix A is a photograph of a fabricated polarization converter having 60 rows by 100 columns of unit cells 8, while FIGS. 4-1 thru 4-4 (when arranged as shown by FIG. 4) provide a drawing of the preferred embodiment (also shown by the photograph of Appendix A) of the present invention in greater detail. The unit cells of FIGS. 4-1 thru 4-4 each have a size of 0.4 mm so that the cutoff frequency between the first and second solutions of Maxwell's equations is approximately 13.5 GHz when the dielectric substrate has a permittivity of about 2.2 and the unit cells are metallic. Standard printed circuit board fabrication techniques can be used to fabricate the polarization converter of FIGS. 4-1 thru 4-4 using, for example, Rogers 5880 as the substrate material 12.

Surface waves can be incident in either direction and these are labeled "Forward" and "Reverse" as illustrated in FIGS. 3*a* and 3*b*. The surface waves in forward and reverse directions are incident on patches with slice rotations of 0 and 90 degrees respectively. Between these two incident regions the slice angle is gradually rotated. Depending on the direction (forward or reverse as noted on FIGS. 3*a* and 3*b*) and polarization of the incident wave the surface has different properties, which are identified in Table 1 below:

TABLE I

| | Forward | Reverse |
|---|---|---|
| TM Incidence | Converts to surface bound TE wave | Radiates a Leaky Wave |
| TE Incidence | Radiates a Leaky Wave | Converts to surface bound TM wave |

A TE mode surface wave incident in the forward direction of FIG. 3*a* or 3*b* does not convert because the surface does not support a bound TE mode in this direction and it immediately leaks (see the upper set of modes of FIGS. 2*a*-2*c*). But, on the other hand, a TE mode surface wave incident in the reverse direction does convert because the surface does support a bound TE mode in this direction (see the lower set of modes of FIGS. 2*a*-2*c*) and the surface of FIG. 3*a* or 3*b* converts it to a surface bound TM mode wave exiting the array at the "forward" end having the same direction of propagation as surface bound TE wave applied at the "reverse" end. So in this case the "forward" end acts as the output of the electromagnetic transport medium while the "reverse" end acts as the input of the electromagnetic transport medium. It should be noted that the direction of propagation of the surface bound electromagnetic wave at the input end is parallel to and the same as the direction of propagation of the surface bound electromagnetic wave at the output end for those instances where the inputted surface bound electromagnetic wave remains surface bound.

A TM mode surface bound wave incident in the reverse direction of FIG. 3*a* or 3*b* does not convert because the surface does not support a surface bound TM mode in this direction and it immediately leaks (see the upper set of modes of FIGS. 2*a*-2*c*). But, on the other hand, a TM mode surface wave incident in the forward direction does convert because the surface does support a bound TM mode in this direction (see the lower set of modes of FIGS. 2*a*-2*c*) and the surface of FIG. 3*a* or 3*b* converts it to a surface bound TE mode wave exiting the array at the reverse end of the polarization convertor with surface bound TE mode wave having the same direction of propagation as applied surface bound TM wave. So in this case the "forward" end acts as the input of the electromagnetic transport medium while the "reverse" end acts as the output of the electromagnetic transport medium. So the direction of propagation of the surface bound electromagnetic wave at the input end is parallel to and the same as the direction of propagation as the surface bound electromagnetic wave at the output end for those instances where the inputted surface bound electromagnetic wave remains surface bound.

Figure 3C:
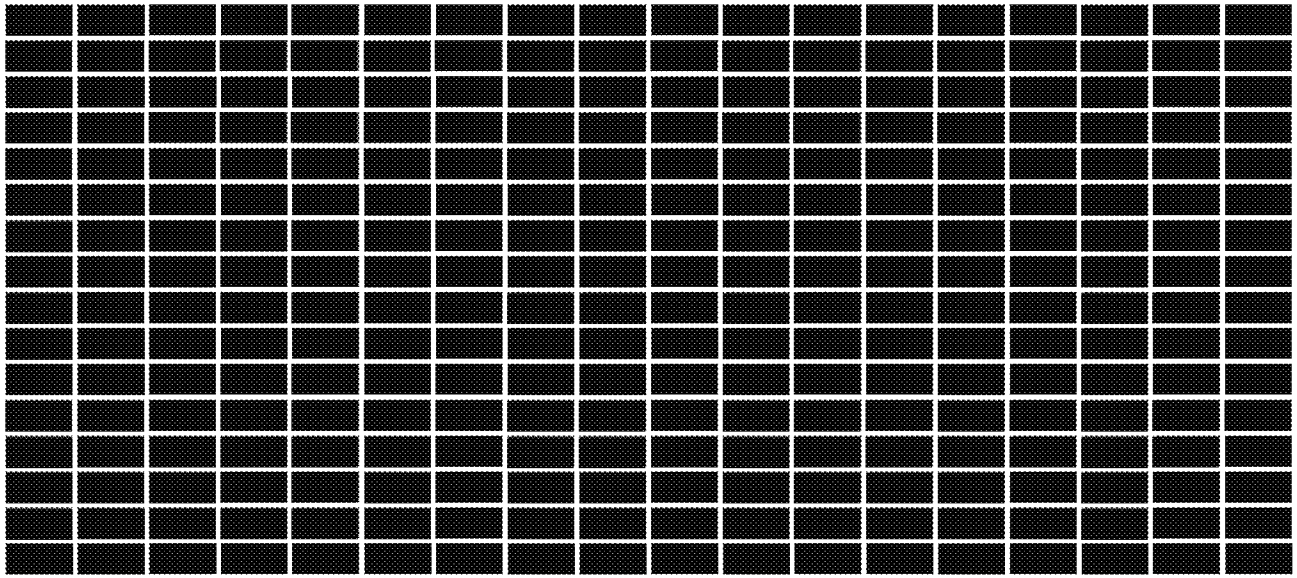
FIG. 3*c* illustrates a matrix of square patches of the electromagnetic transport medium wherein slices through matrix of square patches remain directed in a first direction and hence this is a homogeneous surface that is not used to convert polarization, but rather is used for comparison purposes. The impedance tensor of FIG. 3*c* is spatially homogenous rather than anisotropic as depicted in the embodiments of FIGS. 3*a* and 3*b*.
Figures 4, 5:
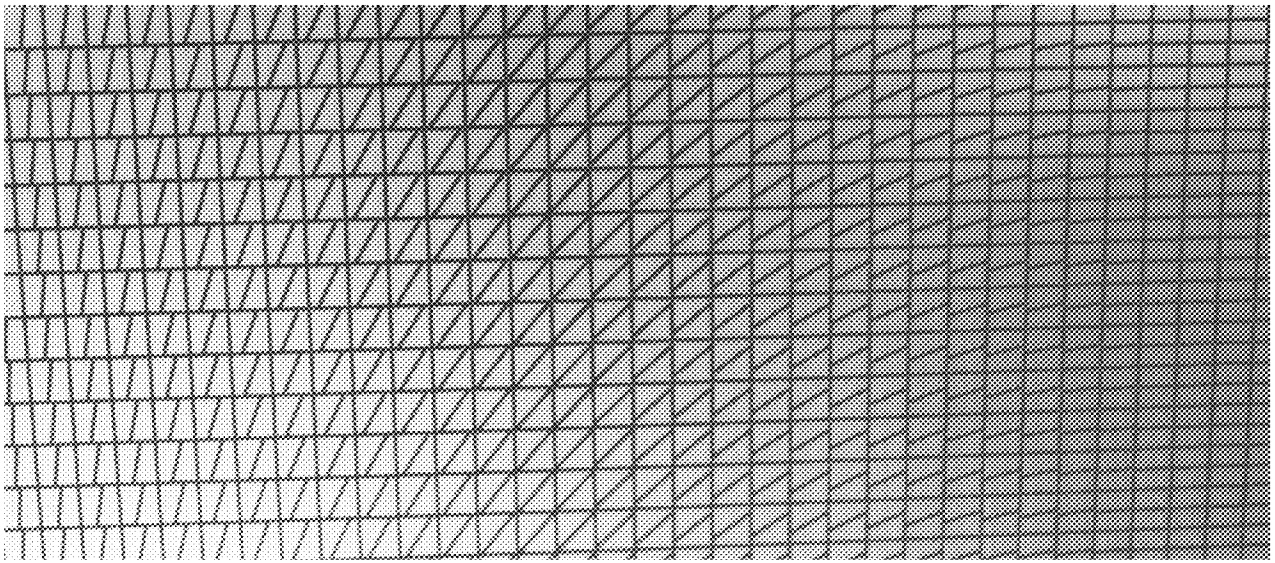
Figure 5:
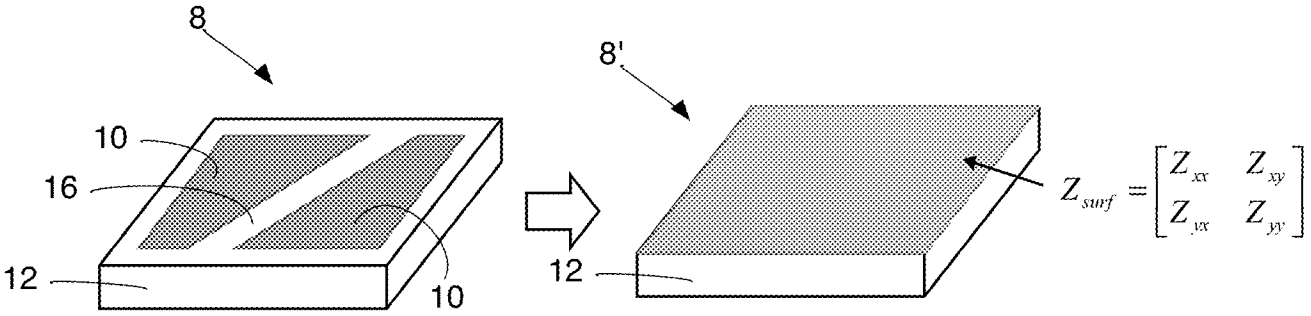
Figure 5A:
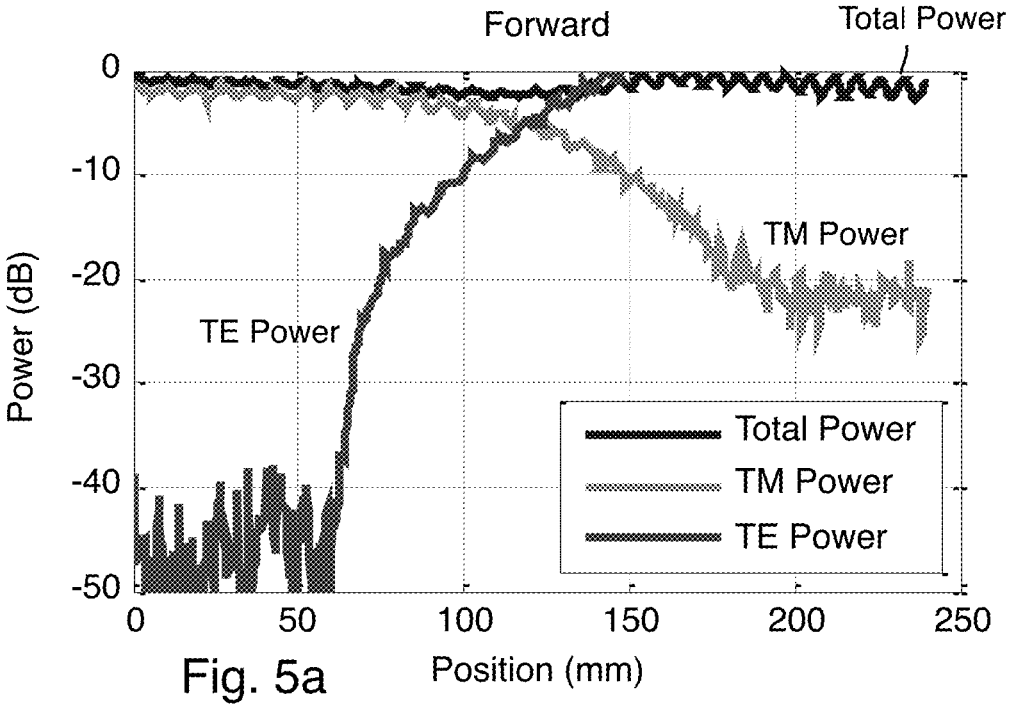
FIGS. 5*a*, 5*b* and 5*c* are simulation graphs illustrating the conversion results for TM mode electro-magnetic waves incident on the forward direction side of the matrix, the reverse direction side of the matrix and a homogenous case, respectively.
Figure 5B:
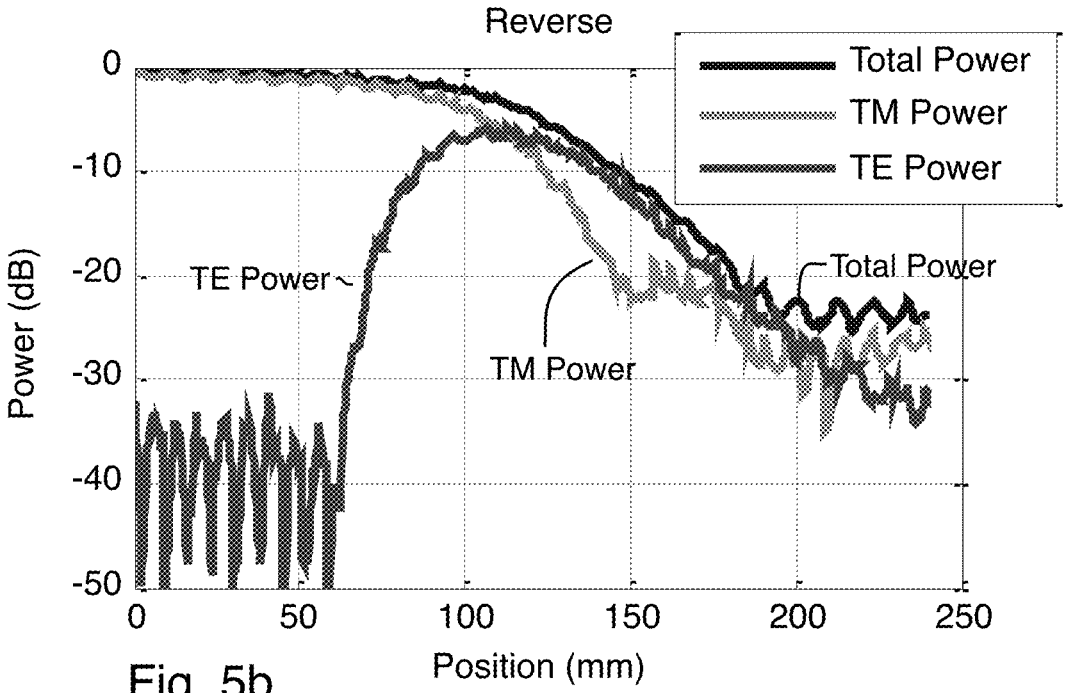
Figure 5C:
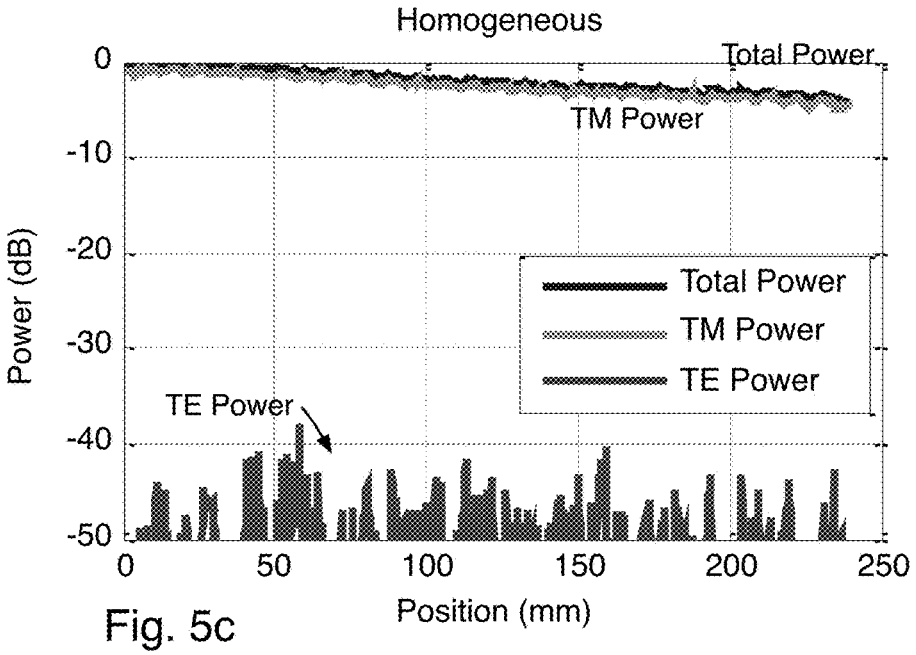

The structure shown in Appendix A and FIG. 4 was too large to simulate with readily available computing hardware. The simulation is large primarily because of the complex metal patterns forming the unit cells 8 on the surface. In order to simplify the simulation while still obtaining accurate results, the metal patches 10 can instead be modeled using tensor impedance boundary conditions. The parameters of the boundary condition are determined by performing a simulation using an entire unit cell 8. Based on the results, an equivalent surface impedance can be extracted and then used in place of the metal patches 10 of a unit cell 8. The simplified structure, as shown in FIG. 5, using a mathematically simulated unit cell 8' can be used in a computer simulation having a large number of unit cells 8 much more efficiently. This method was used to simulate the full 60×100 unit cell structure of Appendix A and of FIG. 4, where each unit cell 8 is replaced with an equivalent version 8' using a tensor impedance boundary condition in place of the metal patches 10. FIGS. 5*a*, 5*b* and 5*c* show simulated polarization conversion results. A TM surface electromagnetic wave was launched in both the forward and reverse directions of the polarization converter of appendix A and of FIG. 4. More than 99% of the TM wave is converted to TE when applied in the correct direction. In the forward direction, as shown by FIG. 5*a*, the TM mode surface bound electromagnetic wave converts to a TE mode surface bound electromagnetic wave and the total power stays nearly constant. In FIG. 5*b*, the reverse direction is shown where the TM mode converts (in theory) to a TE electromagnetic wave and radiation occurs since it is leaky. Therefore, the total power at the forward end is down by 20 dB. The polarization converter was compared to a spatially homogenous tensor impedance surface, an example of which is shown in FIG. 3*c*, that consists entirely of a single unit cell 8 (hence the gap 16 does not change direction). The homogenous surface does not convert the mode polarization, and its purpose is to quantify the effect of losses and beam divergence of the surface wave mode. In the homogeneous case, FIG. 3*c*, the wave is not converted and the TE power stays at the noise floor. The slight drop in TM power and Total power is due to divergence of the beam and losses.

Figure 6:
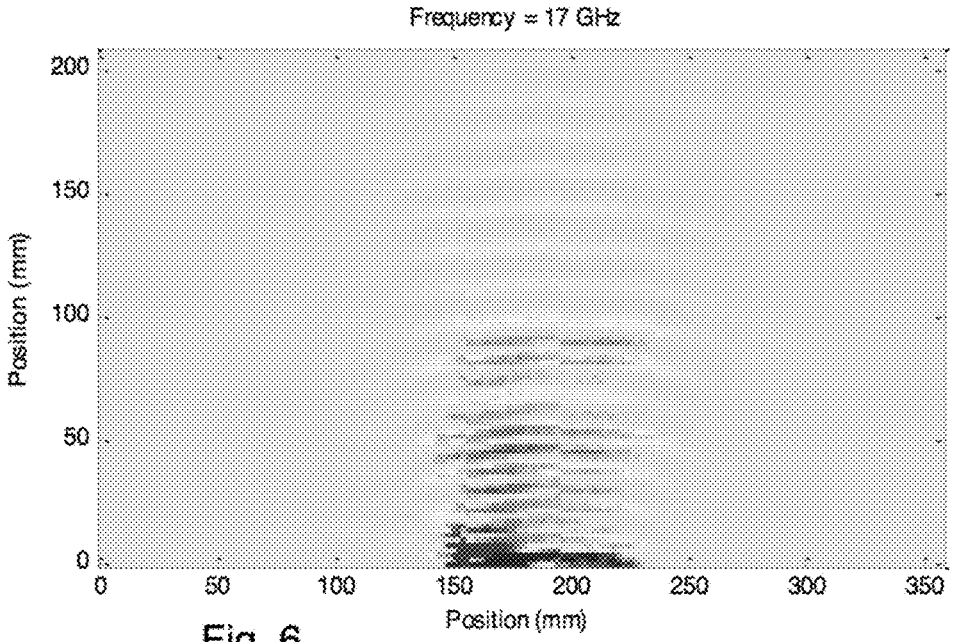
FIG. 6 shows measured TM fields for TM mode electromagnetic waves incident in the forward direction on the forward direction side of the matrix.
Figure 7A:
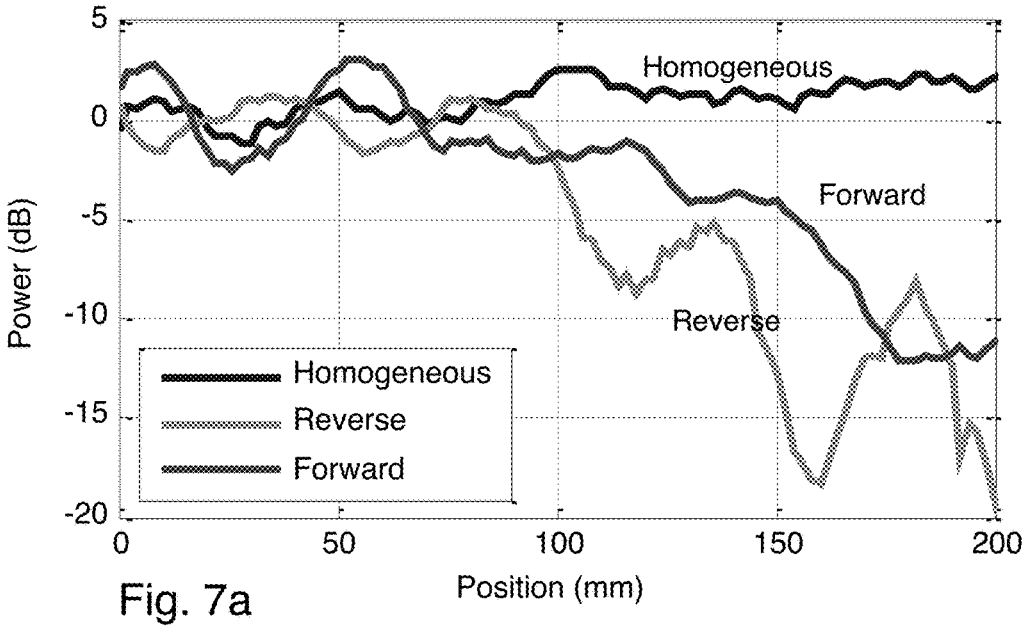
FIGS. 7*a* and 7*b* are graphs showing measured TM fields vs. position (see FIG. 4) at 17 GHz and TM fields vs. frequency, respectively.
Figure 7B:
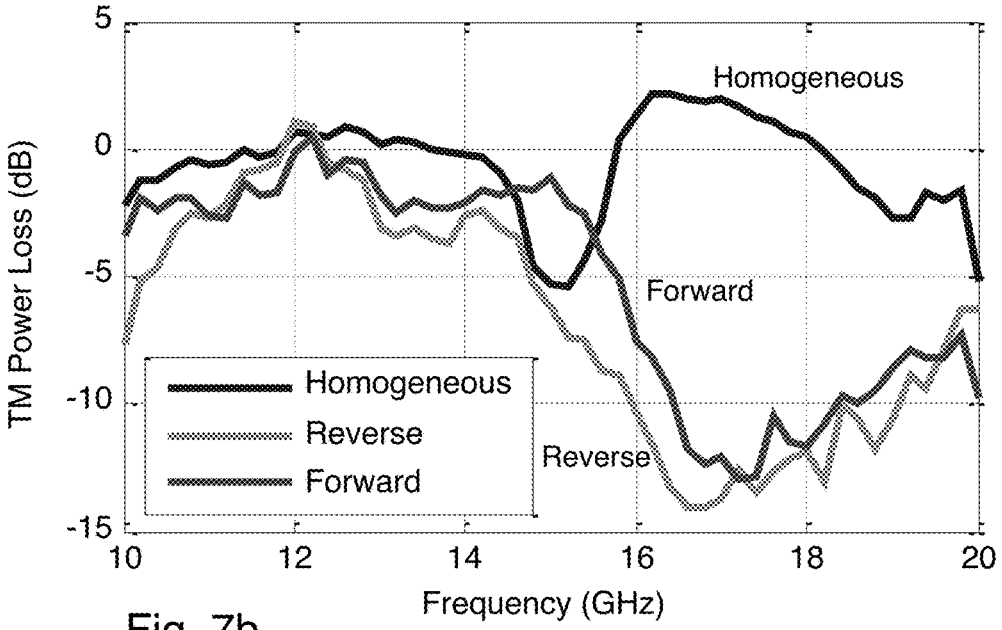

FIG. 6 illustrates a measured field plot at 17 GHz of the embodiment of the polarization converter of Appendix A and of FIG. 4. The surface wave is incident from the bottom and fed in the forward direction (see FIG. 4). The field magnitude is relatively constant until the start of the converter (where the slices start rotating in 3 degree increments for this embodiment). As the wave is converted from TM to TE the measured fields drop because the probe only measures TM fields. One dimensional field plots were taken along the center of the beam to measure the decay of the TM wave. These one dimensional plots were obtained in the forward and reverse directions and also along a homogeneous surface (the TM electromagnetic wave was applied to the "forward" end of the polarization converter of appendix A and of FIG. 4 for both measurements). FIG. 7*a* shows the results versus position in the polarization converter while FIG. 7*b* depicts the results versus frequency. Note that while the TE cutoff frequency is about 13.5 GHz for this embodiment (as shown by FIG. 2*a*), in practice the invention performs better when the frequency of the applied electromagnetic wave is about 25% to 50% higher than the TE cutoff frequency.

A homogeneous board was measured along with the forward and reverse direction. In each case a TM wave was excited incident to the 60×100 unit cell surface. For the homogeneous board the measured TM surface wave power is relatively constant. Both forward and reverse directions show significant drops in TM surface wave power due to the polarization conversion (and TE power radiation in the reverse case of FIG. 5*c*). The final power at the end of the board was about 13 dB below the initial power. This is a 95% conversion rate. In FIG. 7*b*, the difference in TM surface wave power between the front and back of the converter is plotted. This converter operates from 15.5-20 GHz with peak conversion measured around 17 GHz. The dimensions of the unit cell 8 and the dielectric constant of the dielectric on which the metal patches 10 are disposed set the bandwidth of the surface. The power conversion efficiency of the surface is controlled by the numbers of unit cells 8 embodied on the surface.

Figure 8A:
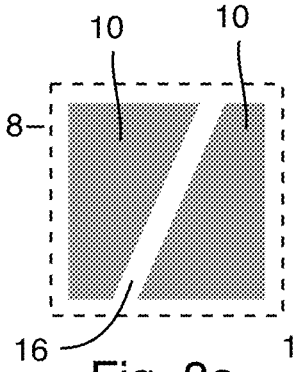
FIGS. 8*a*, 8*b*, 8*c*, 8*d*, 8*e*, 8*f*, and 8*g* are illustrations of alternate tensor impedance unit cell embodiments.
Figure 8B:
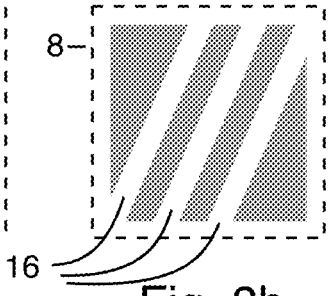
Figure 8C:
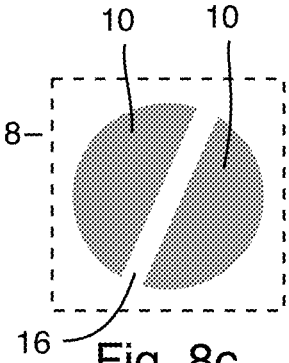
Figure 8D:
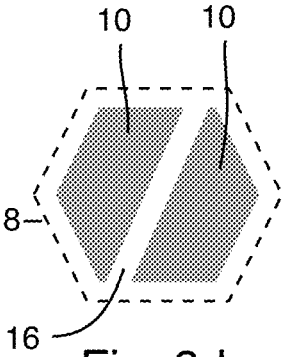
Figure 8E:
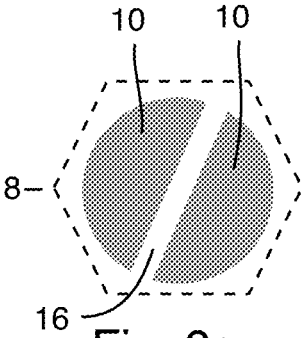
Figure 8F:
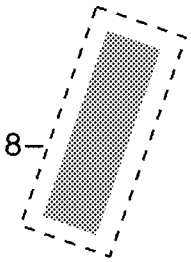
Figure 8G:
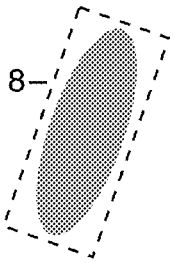

The preferred embodiment comprises a square unit cell with a sliced patch that has two metallic sections or patches 10. The unit cell can assume multiple additional forms, some of which are illustrated in FIGS. 8*a*-8*g*. FIG. 8*a* shows a square unit cell 8 with a single slice or gap 16. FIG. 8*b* shows a square unit cell 8 with multiple slices or gaps 16. FIG. 8*c* shows a square unit cell 8 with a circular metallic patch with a single slice 16. FIG. 8*d* shows a hexagonally-shaped unit cell 8 with a hexagonally-shaped patch and a single slice 16. FIG. 8*e* shows a hexagonal unit cell 8 with a circular patch having a single slice (defined by gap 16). FIG. 8*f* shows a rectangular unit cell 8 with a rectangular patch. FIG. 8*g* shows a rectangular unit cell 8 with an oval patch. The unit cell 8 can be rectangular, hexagonal, or any shape that can be arrayed into a two dimensional lattice or matrix. The conductive patches 10 in the preferred embodiment are formed by cutting or defining a slice or gap 16 through a square shaped of piece of metal, thus creating two portions. However, any anisotropy of the patch shape which creates an anisotropic impedance that can be used for polarization conversion, so slices (defined by gaps 16), while convenient to engineer, are not required. So the patch can consist of one or more portions in the form of any closed shapes. The shape of the unit cell should vary spatially, as long as the correct dispersion and mode characteristics are obtained, to produce the desired anisotropy.

In the preferred embodiment the unit cell 8 (a metallic patch preferably divided by at least one slice 16) has a dimension of ⅕ wavelength (assuming substrate 12 has a dielectric constant of 2.2). Any unit cell dimension less than ½ wavelength can be used assuming that the dielectric constant of the substrate 12 is adjusted according. What is important is that the TE cutoff frequency is determined from a second solution of Maxwell's equations as mentioned above. But in general, frequency of operation varies inversely with unit cell size (when the dielectric constant of the substrate material 12 remains fixed. The method by which the polarization converter operates applies to any region in the electromagnetic spectrum including RF, microwave, THz, infrared, and optical.

Gaps 16 in the unit cells 8 are not necessary, and FIGS. 8*f* and 8*g* show embodiments without gaps 16. The fundamental aspect of the unit cells 8 is that, when arrayed on a dielectric substrate they define an anisotropic substrate, and importantly they are sized to utilize the hybrid TM-TE mode (corresponding to a second solution of Maxwell's equations). The array of unit cells 8 exhibit a gradual rotation of the unit cells 8 9 or of their slices) which results in a gradual rotation of the impedance tensor across the dielectric substrate in order to provide the desired anisotropy so that the polarization of an applied, surface-bound wave is converted as described herein.

The use of gaps 16 (whose angles vary—slowly rotate—across the dielectric substrate) is a convenient way of producing an impedance tensor in the dielectric substrate which spatially rotates (preferably slowly).

Rotating the principle axes of the impedance tensor by 90 degrees is what converts between pure TM and pure TE modes. In practice, if it's close, such as from 5-85 degrees, that would probably be indistinguishable (from a testing viewpoint) from 0-90.

The conversion does not necessarily need to be between pure TM or pure TE modes, but instead can be between any linear combination of TM and TE to a different combination of TM and TE modes. So, any rotation angle of the impedance tensor on the disclosed polarization convertor could be selected.

Having now described the invention in accordance with the requirements of the patent statutes, those skilled in this art will understand how to make changes and modification s to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable.

Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims.

No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step (s) of . . . ."

What is claimed is:

1. An apparatus for converting a polarization of electromagnetic surface-bound waves from either (i) a pure TE mode to a pure TM mode or (ii) from a pure TM mode to a pure TE mode or (iii) from one linear combination of a TE mode and a TM mode to a different linear combination of a TE mode and a TM mode, said apparatus comprising:

a. dielectric substrate or surface; and b. a plurality of electrically conductive unit cells disposed on said dielectric substrate or surface and arranged in an array of unit cells, the size or sizes of the unit cells and the material of the dielectric substrate or surface being selected such that it has a TE mode cutoff frequency which is determined from a second solution of Maxwell's equations based on the dimensions of said unit cells and further based on the material of said dielectric surface, with a frequency of the converted surface bound waves applied thereto, in use, being greater than said TE mode cutoff frequency.

2. The apparatus of claim 1 wherein each unit cell in said array is divided into two or more portions with one or more gaps between said portions so that each unit cell comprises a plurality of patches or plates separated by one or more gaps.

3. The apparatus of claim 1 wherein each unit cell in said array is divided into two portions with a single gap between said portions so that each unit cell comprises a pair of patches or plates separated by said single gap.

4. The apparatus of claim 3 wherein each unit cell is spaced from a neighboring unit cell in said array by a first distance and wherein the pair of patches or plates of each unit cell are separated from each other by said gap having a second distance.

5. The apparatus of claim 4 wherein the first distance and the second distance are the same.

6. The apparatus of claim 1 further including a ground plane disposed on one side of said dielectric substrate or surface opposite a second side thereof and wherein said plurality of electrically conductive unit cells are disposed on said second side of said dielectric substrate or surface.

7. The apparatus of claim 6 wherein said ground plane is formed of a metallic material and wherein a pair or plurality of patches or plates of each unit cell are formed of a metallic material.

8. The apparatus of claim 1 wherein said array has a plurality of rows and columns of said unit cells and wherein unit cells are disposed in identical rows of unit cells between a surface wave input end and a surface wave output end.

9. The apparatus of claim 8 wherein each unit cell in said array is separated into two portions with a single gap between said portions of each unit cell so that each unit cell comprises a pair of patches or plates separated by said single gap, wherein the gaps in the unit cells disposed in identical rows of unit cells in said array vary in orientation columnwise.

10. The apparatus of claim 1 wherein said TE cutoff frequency is lower than a frequency of the electro-magnetic surface waves to be converted by said apparatus.

11. An apparatus comprising:

a. dielectric substrate having a ground plane on one side thereof; and b. a plurality of electrically conductive unit cells disposed on another side of said dielectric substrate and arranged in an array of unit cells for supporting a hybrid TM-TE mode, the dimensions of the unit cells in said array and the material of the dielectric surface being selected such that a second solution of Maxwell's equations based on the dimensions of the unit cells and further based on the material of the dielectric surface results in a TE mode cutoff frequency defined by said second solution of Maxwell's equations, the plurality of electrically conductive unit cells and a dielectric constant of the dielectric substrate defining an anisotropic impedance tensor of said array of the array of unit cells for supporting said hybrid TM-TE mode at frequencies higher than said TE mode cutoff frequency.

12. The apparatus of claim 1 wherein said dielectric substrate has a surface wave input at one portion thereof and a surface wave output at another portion thereof and wherein said array of unit cells are disposed between said surface wave input and said surface wave output and provide said anisotropic impedance tensor in said array between said surface wave input and said surface wave output.

13. The apparatus of claim 12 wherein at least a portion of said dielectric substrate between said surface wave input and surface wave output supports a hybrid TM-TE mode at frequencies higher than said TE cutoff frequency.

14. An apparatus for converting a polarization of electromagnetic surface-bound waves between a surface wave input and a surface wave output from (i) a pure TE mode to a pure TM mode and (ii) from a pure TM mode to a pure TE mode and (iii) from a linear combination of a TE mode and a TM mode to a different linear combination of a TE mode and a TM mode, said apparatus comprising:

a. dielectric substrate having said surface wave input at one portion thereof and said surface wave output at another portion thereof; and b. a plurality of electrically conductive unit cells disposed on said dielectric substrate and arranged in an array of unit cells between said surface wave input and said surface wave output, the size or sizes of the unit cells and the material of the dielectric surface being selected such the plurality of electrically conductive unit cells and a dielectric constant of the dielectric substrate defines an anisotropic impedance tensor in said dielectric substrate between said surface wave input and said surface wave output.

15. The apparatus of claim 14 wherein each unit cell in said array is divided into two or more portions with one or more gaps between said portions of each unit cell so that each unit cell comprises a plurality of patches or plates separated by one or more gaps.

16. The apparatus of claim 15 wherein each unit cell in said array is divided into two portions with a single gap between said portions of each unit cell so that each unit cell comprises a pair of patches or plates separated by said single gap.

17. The apparatus of claim 16 wherein each unit cell is spaced from a neighboring unit cell in said array by a first distance and wherein said gap or gaps are equal to a second distance.

18. The apparatus of claim 17 wherein the first distance and the second distance are the same distance.

19. The apparatus of claim 17 further including a ground plane disposed on one side of said dielectric surface opposite a second side thereof and wherein said plurality of electrically conductive unit cells are disposed on said second side of said dielectric surface.

20. The apparatus of claim 19 wherein said ground plane is formed of a metallic material and wherein said pair of patches or plates of each unit cell are also formed of a metallic material.

21. The apparatus of claim 14 wherein said array has a plurality of rows and columns of said unit cells and wherein unit cells are disposed in identical rows of unit cells between said surface wave input end and said surface wave output end.

22. An apparatus for converting a polarization of electromagnetic surface-bound waves between a surface wave input and a surface wave output from either (i) a pure TE mode to a pure TM mode or (ii) from a pure TM mode to a pure TE mode or (iii) from a linear combination of a TE mode and a TM mode to a different linear combination of a TE mode and a TM mode, said apparatus comprising:

a. dielectric substrate having said surface wave input at one portion thereof and said surface wave output at another portion thereof; and b. a plurality of electrically conductive unit cells disposed on said dielectric substrate and arranged in an array of unit cells between said surface wave input and said surface wave output, the dimensions of the unit cells and the material of the dielectric surface being selected such the plurality of electrically conductive unit cells and a dielectric constant of the dielectric substrate defines an anisotropic impedance tensor in said dielectric substrate between said surface wave input and said surface wave output, wherein each unit cell in said array is separated into two portions with a single gap between said portions of each unit cell so that each unit cell comprises a pair of patches or plates separated by said single gap, wherein the gaps in the unit cells disposed in identical rows of unit cells in said array vary in orientation column-wise.

23. The apparatus of claim 14 wherein a TE cutoff frequency of said array is lower than a frequency of the electro-magnetic surface waves converted by said apparatus.

24. An apparatus comprising:

a. dielectric substrate having a ground plane on one side thereof; and b. a plurality of electrically conductive unit cells disposed on another side of said dielectric substrate and arranged in an array of unit cells with the unit cells having a common external geometry and having at least one slice dividing the geometry of each unit's cell into at least two portions, the slices dividing the unit cells having various angles of rotation relative to the geometry of the unit cells, the size or sizes of the unit cells, the material of the dielectric surface and the various angles of rotation of the slices being selected such that the plurality of electrically conductive unit cells and a dielectric constant of the dielectric substrate define an anisotropic impedance tensor in said dielectric substrate with the various angles of rotation of the slices rotating in a common direction of rotation by 90 degrees between a first side of said array and a second opposing side of said array.

25. The apparatus of claim 24 wherein said first side of said array provides a surface wave input of said apparatus and the second opposing side of said array provides a surface wave output of said apparatus with the anisotropic impedance tensor in said dielectric substrate occurring between said surface wave input and said surface wave output.

* * * * *